US006229455B1

(12) United States Patent
Yost et al.

(10) Patent No.: US 6,229,455 B1
(45) Date of Patent: May 8, 2001

(54) VEHICLE-DETECTING UNIT FOR USE WITH ELECTRONIC PARKING METER

(75) Inventors: Vincent G. Yost, Harleysville, PA (US); David A. Saar, Titusville, NJ (US)

(73) Assignee: Intelligent Devices, Inc., Harleysville, PA (US)

( * ) Notice: Subject to any disclaimer, the term of this patent is extended or adjusted under 35 U.S.C. 154(b) by 0 days.

(21) Appl. No.: 09/270,548

(22) Filed: Mar. 17, 1999

Related U.S. Application Data

(63) Continuation-in-part of application No. 09/231,718, filed on Jan. 15, 1999.

(51) Int. Cl.[7] ..... G08G 1/04
(52) U.S. Cl. ..... 340/943; 340/932.2; 340/933
(58) Field of Search ..... 340/942, 943, 340/933, 932.2, 935–937

(56) References Cited

U.S. PATENT DOCUMENTS

| | | | |
|---|---|---|---|
| Re. 29,511 | 1/1978 | Rubenstein | 368/6 |
| 3,015,208 | 1/1962 | Armer | 368/6 |
| 3,018,615 | 1/1962 | Minton et al. | 368/7 |
| 3,034,287 | 5/1962 | Odom et al. | 368/6 |
| 3,042,303 | 7/1962 | Kendall et al. | 377/9 |
| 3,046,519 | 7/1962 | Polster | 340/943 |
| 3,046,520 | 7/1962 | Polster | 340/935 |
| 3,054,251 | 9/1962 | Handley et al. | 368/6 |
| 3,064,416 | 11/1962 | Armer | 368/6 |
| 3,105,953 | 10/1963 | Polster | 340/935 |
| 3,535,870 | 10/1970 | Mitchell | 368/6 |
| 3,999,372 | 12/1976 | Welch et al. | 368/6 |
| 4,043,117 | 8/1977 | Maresca et al. | 368/6 |
| 4,183,205 | 1/1980 | Kaiser | 368/90 |
| 4,591,823 | 5/1986 | Horvat | 340/936 |
| 4,823,928 | 4/1989 | Speas | 194/217 |
| 4,825,425 | 4/1989 | Turner | 368/7 |
| 4,845,682 | 7/1989 | Boozer | 367/93 |
| 4,908,617 | 3/1990 | Fuller | 340/932.2 |
| 4,967,895 | 11/1990 | Speas | 194/200 |
| 5,263,006 | 11/1993 | Hermesmeyer | 367/117 |
| 5,361,070 | 11/1994 | McEwan | 342/21 |
| 5,407,049 | 4/1995 | Jacobs | 194/200 |
| 5,442,348 | 8/1995 | Mushell | 340/932.2 |
| 5,454,461 | 10/1995 | Jacobs | 194/200 |
| 5,479,173 | 12/1995 | Yoshioka et al. | 342/70 |
| 5,528,217 | 6/1996 | Adams | 340/435 |
| 5,570,771 | 11/1996 | Jacobs | 194/200 |
| 5,642,119 | 6/1997 | Jacobs | 342/69 |
| 5,761,155 | 6/1998 | Eccardt et al. | 367/99 |
| 5,777,951 | 7/1998 | Mitschele et al. | 368/90 |
| 5,845,268 * | 12/1998 | Moore | 705/418 |
| 5,852,411 | 12/1998 | Jacobs et al. | 340/932.2 |

FOREIGN PATENT DOCUMENTS

| | | | |
|---|---|---|---|
| 2077475 | 12/1981 | (GB) | G07F/12/24 |

* cited by examiner

*Primary Examiner*—Daniel J. Wu
*Assistant Examiner*—Sihong Huang
(74) *Attorney, Agent, or Firm*—Caesar, Rivise, Bernstein, Cohen & Pokotilow, Ltd.

(57) ABSTRACT

A vehicle detector unit and detection method for use with an electronic parking meter for providing the electronic parking meter with the ability to reliably detect the presence or absence of a vehicle in any existing corresponding parking space, independent of the surrounding environment, while using a minimum of power.

53 Claims, 13 Drawing Sheets

6A
6B
6C
6D
6E
6F
6G

ELECTRONIC PARKING METER (EPM)
20
70
350
GND
PWR
RESET
352
356
358
348
354
316
VEHICLE DETECTOR UNIT (VDU)
GND
PWR
MICROCOMPUTER
340
MULTIPLEXER
344
OPTICAL TAMPER SYSTEM
346
ULTRASONIC TRANSDUCERS
321-323
MEMORY
342

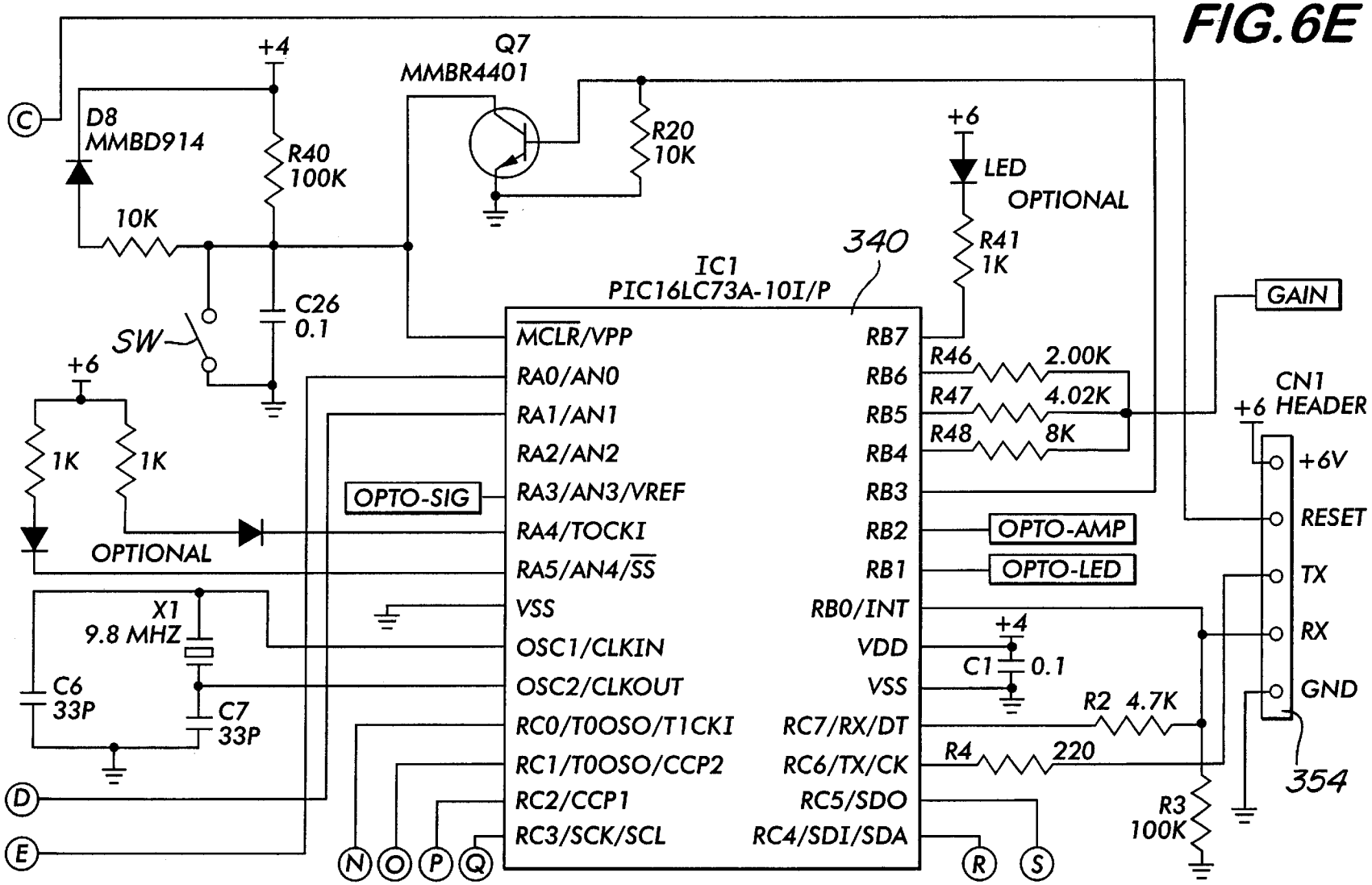
FIG. 6E
GAIN
CN1
+6 HEADER
+6V
RESET
TX
RX
GND
354
R3
100K
R2 4.7K
220
R4
C1 0.1
+4
OPTO-AMP
OPTO-LED
2.00K
4.02K
8K
R46
R47
R48
+6
LED
OPTIONAL
R41
1K
340
IC1
PIC16LC73A-10I/P
RB7
RB6
RB5
RB4
RB3
RB2
RB1
RB0/INT
VDD
VSS
RC7/RX/DT
RC6/TX/CK
RC5/SDO
RC4/SDI/SDA
MCLR/VPP
RA0/AN0
RA1/AN1
RA2/AN2
RA3/AN3/VREF
RA4/TOCKI
RA5/AN4/SS
VSS
OSC1/CLKIN
OSC2/CLKOUT
RC0/T0OSO/T1CKI
RC1/T0OSO/CCP2
RC2/CCP1
RC3/SCK/SCL
OPTO-SIG
R20
10K
Q7
MMBR4401
R40
100K
C26
0.1
+4
D8
MMBD914
10K
SW
1K
1K
+6
OPTIONAL
X1
9.8 MHZ
C7
33P
C6
33P
S
R
Q
P
O
N
C
D
E +4V
R1
4.7K
IC2
24LC04I/SN
VCC
NC
SCL
SDA
NC
NC
NC
VSS
S
R
Q
P
O
N
R42
1K
+4
Q4
MMBR4403LT1
C9
10μF
IC7
74HC4052
VCC
X2
X1
X OUT/IN
X0
X3
A
B
Y0
Y2
Y OUT/IN
Y3
Y1
INH
VEE
GND
344
CH2
AMP IN
CH3
CH1
F
G
J (FIG.6C)
M (FIG.6D)

VEHICLE-DETECTING UNIT FOR USE WITH ELECTRONIC PARKING METER

RELATED APPLICATIONS

This application is a Continuation-in-Part of Co-Pending application Ser. No. 09/231,718 filed Jan. 15, 1999, entitled TOOL-LESS PARKING METER MECHANISM AND ICON DISPLAY which is assigned to the same Assignee of the present invention, namely Intelligent Devices, Inc. and whose disclosure is incorporated by reference herein.

FIELD OF THE INVENTION

This invention relates generally to the field of parking meters and more particularly to electronic parking meters that can detect parked vehicles.

BACKGROUND OF THE INVENTION

Parking meters permit vehicles to be parked on streets for an allowable time determined by the number and denominations of coins which are placed in the parking meter. A clock mechanism in the parking meter runs down the allowable time until it reaches zero, and an overtime parking indication appears.

It has been long recognized that if the parking meter were able to detect the presence or absence of the vehicle, either by mechanical means or wireless means, in the corresponding parking space, then among other things, the parking meter could be reset, thereby requiring the next patron to insert the appropriate amount of payment for his/her parking time. U.S. Pat. No. 3,015,208 (Armer); U.S. Pat. No. 3,018,615 (Minton et al.); U.S. Pat. No. 3,034,287 (Odom et al.); U.S. Pat. No. 3,054,251 (Handley et al.); U.S. Pat. No. 3,064,416 (Armer); U.S. Pat. No. 3,535,870 (Mitchell); U.S. Pat. No. 3,999,372 (Welch); U.S. Pat. No. 4,043,117 (Maresca et al.); U.S. Pat. No. 4,183,205 (Kaiser); U.S. Pat. No. 4,823,928 (Speas); U.S. Pat. No. 4,825,425 (Turner); U.S. Pat. No. 4,908,617 (Fuller); U.S. Pat. No. 4,967,895 (Speas); U.S. Pat. No. 5,442,348 (Mushell); U.S. Pat. No. RE29,511 (Rubenstein).

Thus, the objective of any vehicle detection portion of the electronic parking meter is to, as reliably as possible and as inexpensively as possible, detect when there is and is not a vehicle in the corresponding parking space. In fact, experience has shown that unless vehicle detection is extremely reliable (99%+ in correctly identifying the presence/absence of a vehicle), the customer, i.e., cities and townships, will not invest in vehicle detecting parking meters. However, all of the above references suffer from one of many different problems and actually achieving this objective remains elusive. The reasons for not being able to implement such a working vehicle detector include: the uncertainty of the parking meter location and of the parking meter/space environment, vehicles that are parked too far back in the parking space, the smoothness of the surfaces of different vehicles, the "fast parker", the inadvertent or intentional presence of a person in front of the meter and tampering with the meter including the vandalizing of the sensor itself. Furthermore, the vehicle-detecting parking meter must be able to provide a reliable vehicle-detection scheme that uses low power since the parking meter is a stand-alone device that does not have the luxury of using utility power.

In particular, the environment of the meter/space presents obstacles that must be recognized and compensated for, or distinguished, by the vehicle detector. For example, the road may be very steeply-crowned and an ultrasonic-based vehicle detector will receive reflections from the crowned road, and may erroneously conclude that a vehicle is in the corresponding parking space when there truly is no vehicle there. Another example, is that if trash bins, light posts, trees, sign posts, etc. are closely-adjacent the parking meter, almost any wireless vehicle detection scheme will be subjected to sufficient interferences from these, thereby causing the detector to make erroneous conclusions about the presence/absence of a vehicle in the parking space.

Even the sensor used to implement the vehicle detection suffers from its own respective drawbacks. For example, the use of RADAR (radio detection and ranging) suffers from such things as possible interferences from other RADAR-vehicle-detecting units, frequency band licensing concerns as well as cost. The use of optical sensors in vehicle detection (e.g., U.S. Pat. No. 4,043,117 (Maresca)) suffer from receiving reflections that may vary from strong reflections (reflected off of vehicle glass) versus weak reflections (reflected off the body of a very dark-colored vehicle), which are hard to detect. Videocamera/processing when used for vehicle detection (e.g., U.S. Pat. No. 5,777,951 (Mitschele et al.)) is not only very expensive but in those cases where the video camera is positioned to capture the front-end vehicle license plate, in those states where front-end vehicle license plates are not required, identification of the vehicle is thwarted. Thus, at present, use of ultrasonic sensors remains the most cost-effective means of detecting vehicles.

Prior art vehicle detecting parking meters utilizing a single ultrasonic sensor, such as those disclosed in U.S. Pat. Nos. 5,407,049 (Jacobs), 5,454,461 (Jacobs), U.S. Pat. No. 5,570,771 (Jacobs), U.S. Pat. No. 5,642,119 (Jacobs) and U.S. Pat. No. 5,852,411 (Jacobs et al.), which are assigned to the same assignee as the present invention, namely Intelligent Devices, Inc., operate where the ultrasonic sensor is energized with a pulse for emanating an interrogating signal towards the parking space and then the sensor waits to receive reflections. In particular, the reflections are examined to determine if they exceed a certain fixed threshold and, if so, the time measured between when the interrogating signal was sent until when the reflection was received is used to calculate a distance.

However, some of the problems with such a method are the following: certain vehicles disperse the interrogating signal, rather than returning a strong reflection; another problem is that to compensate for adjacent obstacles, e.g., crowned-street, tree, sign post, etc., the sensitivity of the sensor has to be reduced by raising the threshold but in doing so, even more vehicles are not properly detected; the reflected signals, or echos, are inherently unstable, i.e., the movement of air and even very minute physical movements in the environment make these signals unstable. Furthermore, some echos cancel other echos and exhibit multi-path problems, thus making the echos unstable.

Even where multiple ultrasonic sensors are used to detect vehicles, e.g., U.S. Pat. No. 3,042,303 (Kendall et al.); U.S. Pat. No. 3,046,519 (Polster); U.S. Pat. No. 3,046,520 (Polster); U.S. Pat. No. 3,105,953 (Polster); U.S. Pat. No. 5,263,006 (Hermesmeyer); U.S. Pat. No. 4,845,682 (Boozer et al.), or other objects U.S. Pat. No. 5,761,155 (Eccardt et al.), the design is that at least one sensor acts as an ultrasonic transmitter and the remaining sensors act as the ultrasonic receivers. As a result, there is no teaching or suggestion that each sensor act as both a transmitter/receiver for a signal that monitors a particular portion of the parking space. Furthermore, low power operation of these system is not a concern.

Another problem that is encountered with such vehicle detection systems is a "fast-parker" scenario, i.e., a vehicle pulling into a parking space that has just been emptied but before the vehicle detector has determined that the first vehicle has departed.

With regard to low power electronic parking meters, British Publication No. 2077475 discloses a low power electronic parking meter that operates using solar cells. Furthermore, since the sophisticated electronic parking meters which use microprocessors, electronic displays and IR/ultrasonic transducers consume too much power to operate by non-rechargeable batteries alone, U.S. Pat. No. 4,967,895 (Speas) discloses the use of solar power cells which charge capacitors or rechargeable batteries. However, various problems exist with the use of solar power sources including the use of parking meters in shady areas, or the use of parking meters during periods in which there is very little sunlight. This causes the rechargeable batteries to run down, and they require frequent replacement. Or, in the case of the use of capacitors, the lack of power causes the meter to become inoperative.

Therefore, there remains a need a system and method for providing any electronic parking meter with the ability to detect the presence or the absence of a vehicle in any existing parking meter space, independent of the surrounding environment, as reliably as possible and as inexpensively as possible while using a minimum of power.

OBJECTS OF THE INVENTION

Accordingly, it is the general object of this invention to provide an apparatus which addresses the aforementioned needs.

It is a further object of this invention to provide a vehicle detector unit in combination with a parking meter that reliably detects the presence or the absence of a vehicle positioned in the associated parking space.

It is still a further object of this invention to provide a vehicle detector unit in combination with a parking meter that detects the presence or the absence of a vehicle using an inexpensive detection scheme.

It is still yet a further object of this invention to provide a vehicle detector unit in combination with a parking meter that uses a minimum of power to reliably and inexpensively detect the presence or the absence of a vehicle in the associated parking space.

It is still yet another object of the present invention to provide a vehicle detector unit in combination with a parking meter that minimizes the number of false vehicle departures from, and the number of false vehicle arrivals to, the associated parking space.

It is a further object of this invention to provide a vehicle detector unit that digitizes all of the reflected signals.

It is yet another object of this invention to provide a vehicle detector unit that obtains a profile of the signal values recorded from the sensors that represents the condition of the corresponding parking space.

It is still yet another object of this invention to provide a vehicle detector unit that obtains a baseline electrical profile that represents an empty parking space.

It still yet even further another object of the present invention to provide vehicle detector unit that takes a series of readings of an empty parking space and which obtains the peak values from that series of readings.

It is still yet another object of the present invention to provide a vehicle detector unit that always compares the baseline empty parking space with the returned reflected signals when determining whether a vehicle is or is not in the parking space.

It is still another object of the present invention to provide a vehicle detector unit that seeks the highest values of the reflected signals.

It is still yet another object of the present invention to provide a vehicle detector unit that can detect when a person or object has been positioned in front of the sensor.

It is yet another object of this invention to provide a vehicle detector unit that provides any electronic parking meter with the ability to detect the presence or absence of vehicles in the corresponding parking space.

It is still another object of this invention to provide a vehicle detector unit that does not have to be precisely aimed in order to detect the presence or absence of vehicles in the corresponding parking space.

It is another object of this invention to provide a vehicle detector unit that provides any electronic parking meter with the ability to detect the presence or absence of vehicles in the corresponding parking space without the need to modify the hardware of the electronic parking meter.

It is a further object of this invention to provide a vehicle detector unit that provides any electronic parking meter with the ability to gather statistics on the parking space.

It is a further object of this invention to provide a vehicle detector unit that provides any electronic parking meter with the ability to zero the remaining time off the parking meter when the vehicle departs.

SUMMARY OF THE INVENTION

These and other objects of the instant invention are achieved by providing a vehicle detector unit for use with an electronic parking meter for detecting the presence or absence of a vehicle in a corresponding parking space. The unit comprises: a first signal emitting sensor positioned adjacent the corresponding parking space for transmitting a first signal towards the parking space in a first direction and for receiving a reflection of the first signal; a second signal emitting sensor positioned adjacent the corresponding parking space for transmitting a second signal towards the parking space in a second direction different from the first direction and for receiving a reflection of the second signal; and processing means coupled to the first and second signal-emitting sensors for processing the reflections of the first and second signals to determine if a vehicle is positioned in the corresponding parking space. The processor means is coupled to the electronic parking meter for communicating the presence or absence of a vehicle in the corresponding parking space to the electronic parking meter.

These and other objects of the present invention are also achieved by providing a method for detecting a vehicle at a parking space, The method comprising the steps of: (a) positioning two signal-emitting sensors adjacent the parking space and wherein the sensors are oriented toward the parking space; (b) alternately activating the two signal-emitting sensors, at a first predetermined interval, and wherein each of the two signal-emitting sensors both emit signals and receive reflections of the emitted signals to form a first set of reflected signals; (c) processing each of the reflected signals to determine if the amplitude of at least one of the first set of reflected signals is above a predetermined threshold; (d) alternately activating the two signal-emitting sensors at a second shorter predetermined interval to both emit signals and to receive reflections of the emitted signals to form a second set of reflected signals whenever the amplitude of at least one reflected signal of the first set of reflected signals exceeds the predetermined threshold; (e) processing each of the second set of reflected signals to determine if a predetermined number of consecutive reflected signals in the second set comprise amplitudes that exceed the predetermined threshold for establishing the presence of a vehicle in the parking space; and (f) transmitting a signal indicative of a vehicle detected.

DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 6E is an electrical schematic of the microcontroller of the vehicle detector unit;

DESCRIPTION OF THE PREFERRED EMBODIMENT OF THE INVENTION

Figure 1:
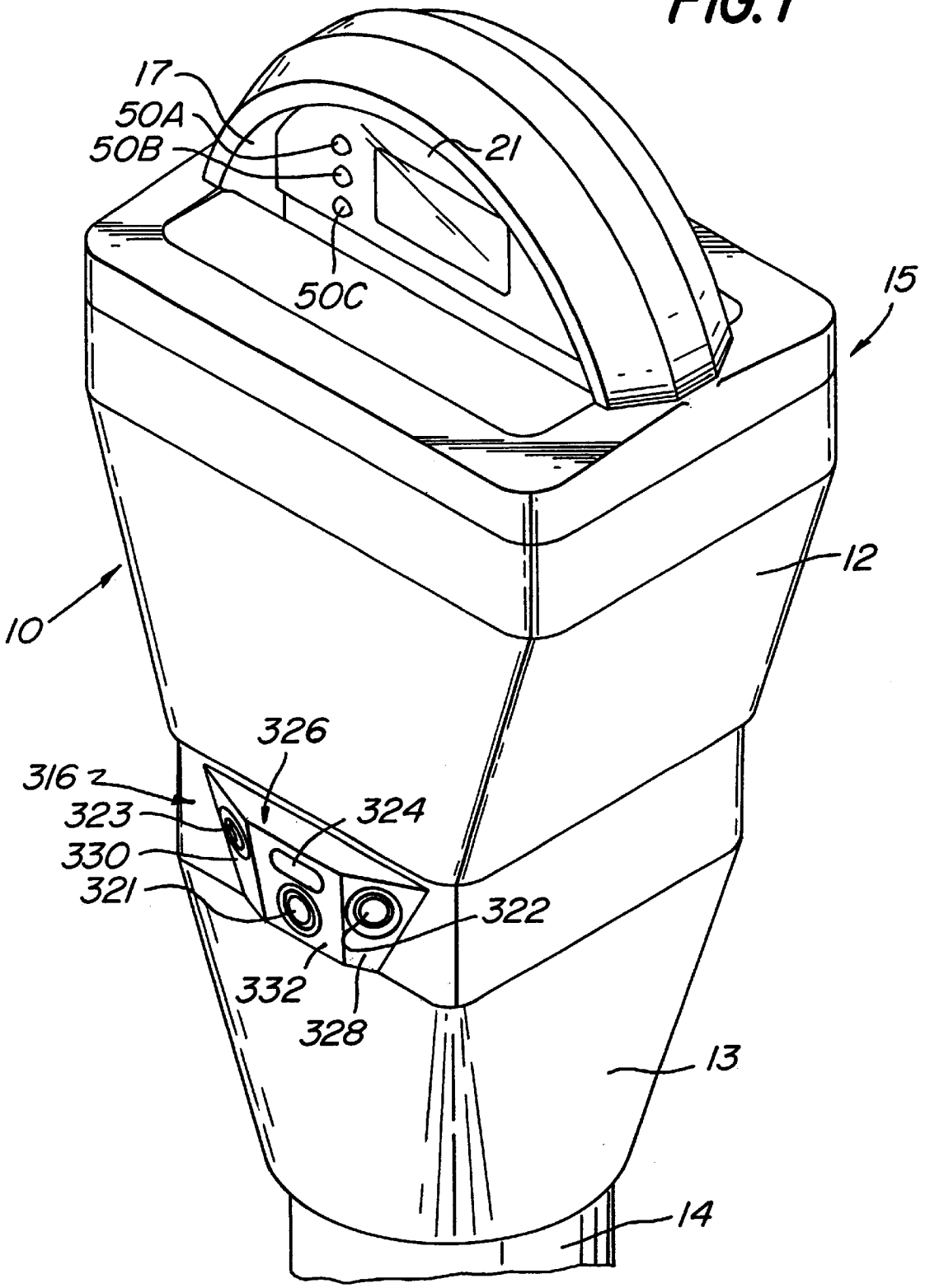
FIG. 1 is an isometric view of the vehicle-side of the present invention.

Referring now in greater detail to the various figures of the drawing wherein like reference characters refer to like parts, a vehicle detector unit (hereinafter "VDU") for use with electronic parking meters constructed in accordance with the present invention is shown generally at 316 in FIG. 1. The VDU 316 issued in conjunction with a parking meter 10 to provide the parking meter 10 with vehicle detection capability. As shown most clearly in FIG. 1, the parking meter 10 comprises a parking meter housing 12 that is supported at the parking space location (not shown) by a stanchion 14. The parking meter housing 12 is coupled to the stanchion 14 via a vault 13 (which receives the deposited coins) and the VDU 316.

The operative part of the parking meter, hereinafter known as the electronic parking meter (EPM) (see FIG. 5; an example of such an EPM is the tool-less parking meter mechanism, TLPMM 20, disclosed in A.S.N. 09/231,718 but it should be understood that any electronic parking meter would suffice) is positioned inside the housing 12. A parking meter cover 15 having a lens portion 17 can only be removed by parking authority personnel only to obtain access to the EPM 20. A top portion 21 of the EPM 20 can be seen through the lens portion 17; three LEDs 50A–50C mounted in the top portion 21 can be used for indicating various parking meter conditions to parking authority personnel.

Figure 3:
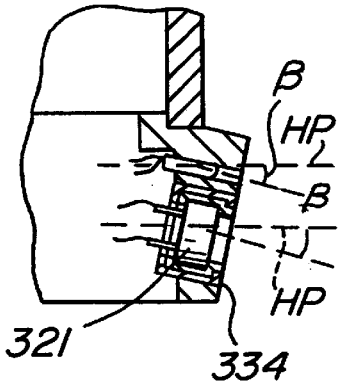
FIG. 3 is a view of the present invention taken along the lines 3—3 of FIG. 2.
Figure 4:
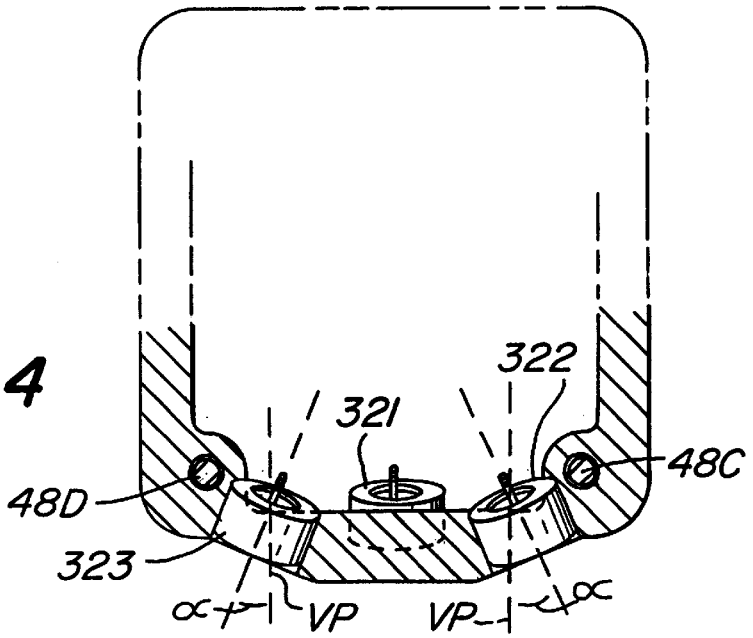
FIG. 4 is a view of the present invention taken along lines 4—4 of FIG. 2.

As shown in FIG. 1, which depicts the street-side of the parking meter 1 ONDU 316, the VDU 316 comprises three ultrasonic transducers 321, 322 and 323 that are specifically oriented to provide the widest and most reliable method of vehicle detection in the associated parking space (not shown). Each transducer has two angular orientations: a directional angle a and a tilt angle β. The directional angle a is that angle formed between a vertical plane VP and the transducer's axis (FIG. 4). The tilt angle β is that angle formed between a horizontal plane HP and the transducer's axis. As used in this invention, the directional angle has a range of $-45° \leqq \alpha \leqq 45°$ (i.e., left or right, respectively, of the plane VP) and the tilt angle has a range of $-30° \leqq \beta 30°$ (i.e., above or below, respectively, of the plane HP). As an example, for parking meters used in the United States, the preferred directional angles and tilt angles are as follows: the outer transducers, namely transducers 321 and 323 are positioned 22½°(α) away from a vertical plane VP in opposite directions (FIG. 4). In addition, all three transducers 321–323 are positioned 12°(β) downward from a horizontal plane HP (FIG. 3). On the other hand, where different configurations of parking meters are used, e.g., where the VDU 316 is actually positioned close to the ground with the transducers' axes tilted upward rather than downward. As a result, the full scope of the associated parking space can be monitored for the presence/absence of a vehicle, even if the patron parks too far back in the space or too far front in the space, or parks very quickly just after a vehicle has departed, as will also be discussed in detail below. Furthermore, positioned over the central transducer 321 is an optical tamper sensor (also to be discussed later) that is located behind a plastic lens 324.

One exemplary manner of establishing these specific angular orientations of the transducers 321–323 is by including a faceted projection 326 on the street-side of the VDU 316. As shown most clearly in FIG. 1, the outer transducers 322 and 323 are located on respective facets 328 and 330 which are constructed with the proper a orientation; the central transducer 321 is located in its corresponding facet 332. All of the facets 328–332 are machined such that the cavity 334 (only one of which is shown in FIG. 3) containing each transducer orients each transducer in the proper β orientation. It should be understood that the faceted projection 326 is exemplary only and that all other means known in the art for establishing the α and β transducer orientations are covered within the broadest scope of the invention.

The VDU 316 is secured between the parking meter housing 12 and the vault 13 using a plurality of bolts 48A–48D (FIG. 1A) that can only be accessed by parking meter personnel, such as disclosed in U.S. Pat. No. 5,852,411 (Jacobs et al.), assigned to the same Assignee of the present invention, namely Intelligent Devices, Inc., and which is incorporated by reference herein. As can be also seen in FIG. 1A, the VDU 316 includes a coin passageway 336 for permitting the coins processed by the EPM 20 to pass through the VDU 316 and into the vault 13. A printed circuit board (PCB) 338, which contains the VDU electronics (FIGS. 6A–6G) can also be seen in FIG. 1A, as is discussed below.

Figures 5, 6:
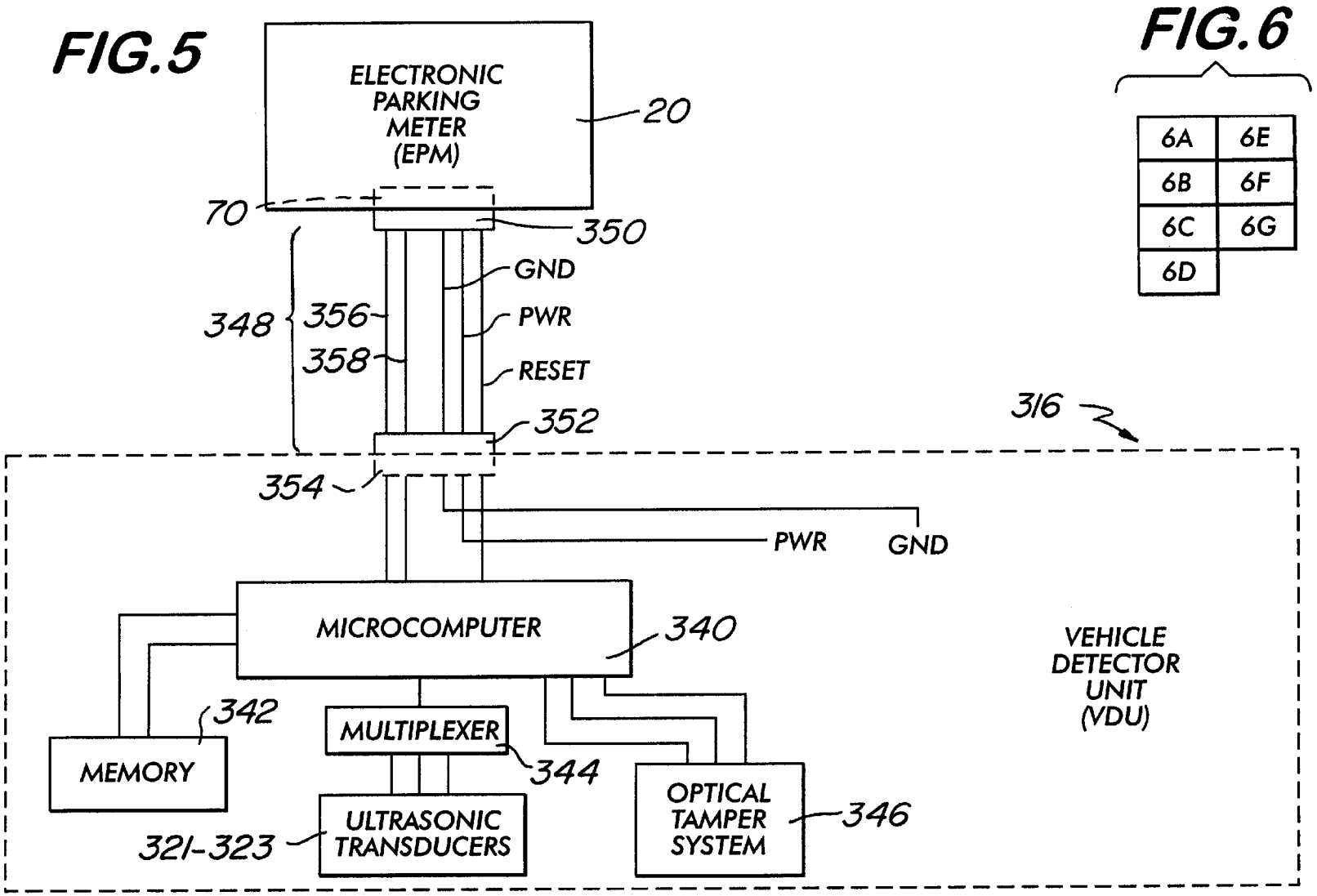
FIG. 5 is a block diagram of the present invention.
FIG. 6 is a figure layout for FIGS. 6A–6G.

A block diagram of the VDU 316 is shown in FIG. 5. The VDU 316 comprises a microcomputer ($\mu$C) 340, memory 342, multiplexer 344, the ultrasonic transducers 321–323 and an optical tamper system (OTS) 346; the optical tamper system 346 forms one portion of a tamper system used in the VDU 316 that is discussed below. An electrical wire harness 348 comprises a first connector 350 and a second connector 352 that plug into respective mating connectors 70 (on the EPM 20) and 354 on the VDU 316. The wire harness 348 provides power (PWR, +6VDC) and ground (GND) from the EPM 20 as well as a reset line (RESET); the RESET line permits the both the EPM 20 and the VDU 316 to be simultaneously reset by parking meter personnel whenever they are doing maintenance on the EPM 20. Furthermore, a "vehicle detected" line 356 and a "tamper" line 358 are also provided for passing a "vehicle-detected" status to the EPM 20 and a tamper status to the EPM 20, respectively, as will be discussed in detail later.

The memory 342 stores the operational parameters of the VDU 316. For example, the memory stores the baseline signals, (e.g., the transducer signals corresponding to an empty parking space, an optical signal of the OTS 346 corresponding to an unobstructed path towards the parking space), reference parameters, transducer frequency data, etc. In addition, the memory can be updated or modified through the EPM 20 via using the "vehicle-detected" line 356 and the "tamper" line 358. In particular, when the baseline signals are obtained for each transducer 321–323, parking meter personnel control that process via a hand-held unit (not shown) that communicates with the EPM 20 and ultimately with the VDU 316.

The multiplexer 344 is used to reduce the amount of circuitry necessary for energizing the transducers 321–323 as well as amplifying the subsequent reflection signals in preparation for processing.

Each ultrasonic transducer 321–323 operates at a nominal frequency, e.g., 40 kHz. To ensure that all possible situations of environmental changes do not affect the vehicle is detection processing, the $\mu$C 340 excites the transducers 321–323 at a slightly higher and lower frequency around the nominal frequency. However, in the baseline case, to detect a vehicle at all, only the nominal frequency is monitored.

The $\mu$C 340 controls the activation of each of the transducers 321–323. It should be understood that the phrase "activating a transducer" as used in this patent application means: (1) energizing the transducer; (2) listening for the reflection; and (3) processing the reflection by the $\mu$C 340 . By way of example, and not limitation, the energization phase is approximately 1 msec, the listening phase is approximately 28 msec and the processing phase is approximately 20 msec. Thus, "activating the transducer" is approximately a 50 msec process. Furthermore, transducer 321 is also referred to as channel 1, transducer 322 is also referred to as channel 2 and transducer 323 is also referred to as channel 3.

The detection methodology basically comprises four modes: (1) empty space mode; (2) car validation mode (aggressive mode); (3) occupied space mode and (4) vehicle departure (hypermode).

Figure 7:
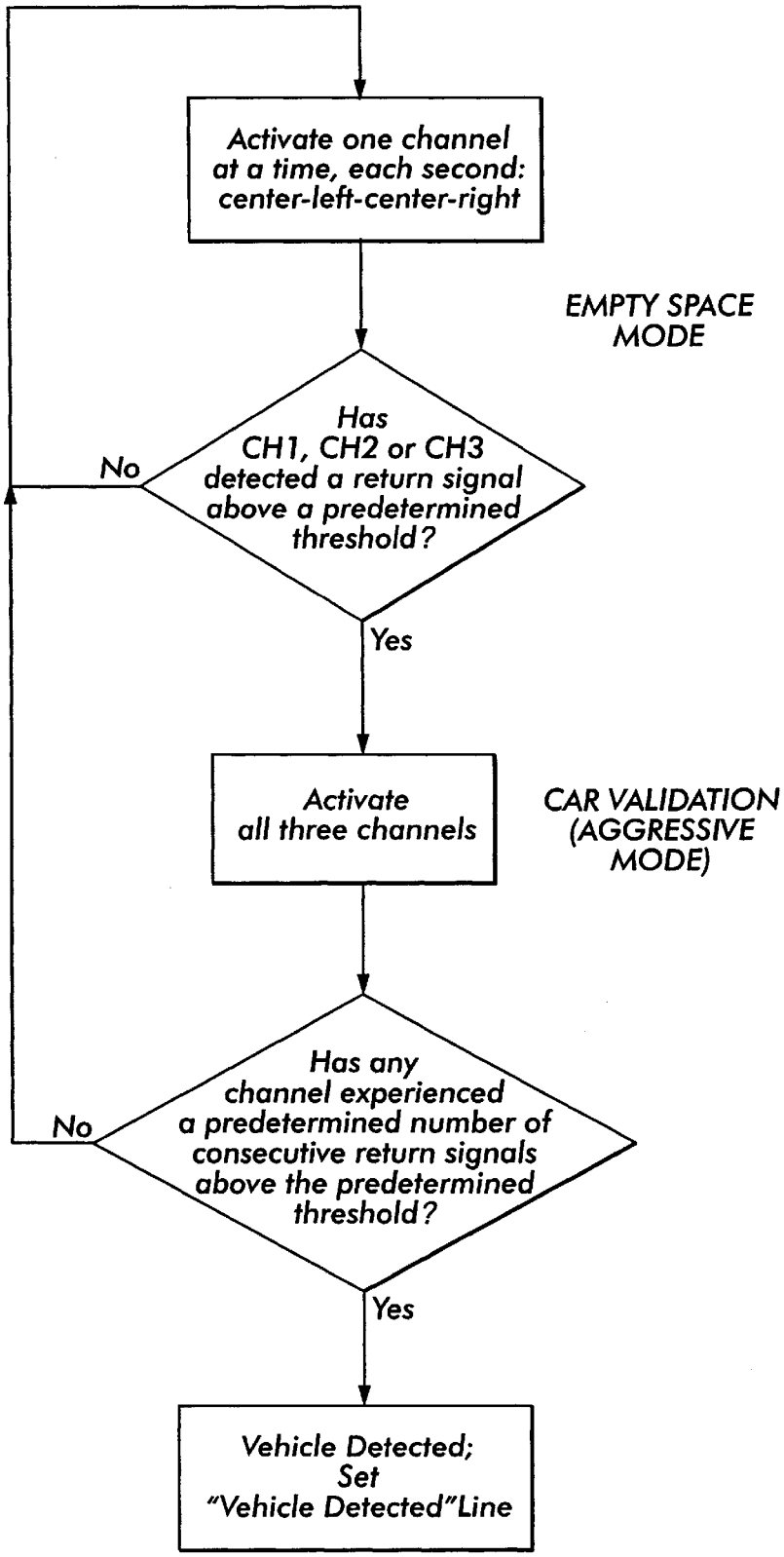
FIG. 7 is a block diagram of the software of the present invention regarding the empty space mode and the car validation mode.

In the empty space mode (FIG. 7), the $\mu$C 340 activates the transducers in a specific sequence: channel 1, channel 2, channel 1 and channel 3 and whereby each channel is activated only once per second. This permits the entire parking space to be accurately monitored while using as little VDU 316 power as possible.

It should be noted that by using this "outer-center-outer-center" activation scheme the central channel, i.e., transducer 321, is being activated every other time since the center transducer 321 tends to detect most vehicles parked in the corresponding parking space. Furthermore, this "outer-center-outer-center" activation scheme is used only during the empty space mode.

Once one of the channels has detected a return signal above a predetermined threshold (e.g., the noise level), the $\mu$C 340 institutes the car validation, or aggressive, mode whereby the transducers 321–323 are activated much more rapidly, e.g., channels 1, 2 and 3 are sequentially activated (150 msec total) and then remain silent for approximately 350 msec and then channels 1, 2 and 3 are again sequentially activated for another 150 msec followed by another period of silence for the remaining 350 msec. This mode is repeated. If any channel detects a predetermined number (e.g., four ) of consecutive return signals above the predetermined threshold above the noise level, then a vehicle is detected. Furthermore, the particular channel that experienced the best above-threshold signal is designated the "favored channel".

Once a car is validated, the $\mu$C 340 institutes the occupied space mode whereby the favored channel is activated only once every second. This mode verifies the vehicle's continued presence while using as little VDU 316 power as possible.

If the favored channel signal terminates, the $\mu$C 340 institutes the vehicle departure, or hypermode. In this mode, the $\mu$C 340 activates the transducers 321–323 much more rapidly, e.g., channels 1, 2 and 3 are sequentially activated (150 msec total) twice a second and then remain silent for the remainder of the second (approximately 700 msec). This mode is repeated. If all three channels experience a predetermined number (e.g., six) of consecutive "no return signals", then the vehicle has departed. The $\mu$C 340 then returns to the empty space mode. If, on the other hand, this predetermined number of consecutive "no return signals" is not achieved, e.g., the favored channel signal returns, or a new favored channel is established, then the $\mu$C 340 returns to the occupied space mode. This "re-establish" operation is important in that intermittent conditions, e.g., snow, rain, etc., that may partially block the ultrasonic transducers 321–323 do not prevent the VDU 316 from continuing to re-establish detection of a parked vehicle.

The VDU 316 electronics are discussed next. It should be noted that Table 1 below contains exemplary part numbers for the various electrical components used in the VDU 316. It should be understood that these components are listed for example only and that the VDU 316 is not limited, in any manner, to only those components.

Figure 6A:
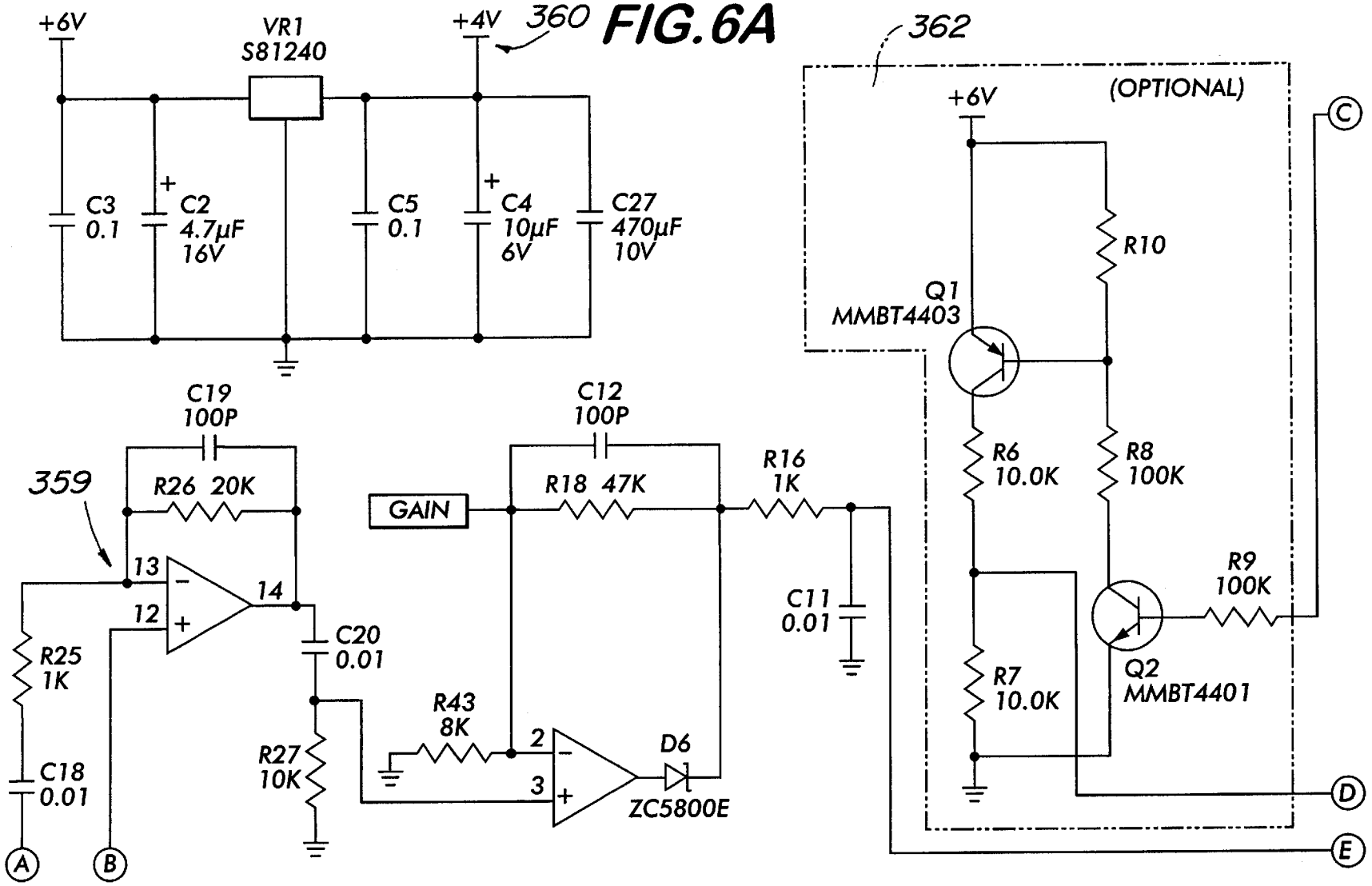
FIG. 6A is an electrical schematic of the vehicle detector unit voltage regulator circuit, a portion of the transducer interface circuit and an optional battery monitoring circuit.

FIG. 6A depicts a voltage regulator circuit 360 that converts the +6VDC from the EPM 20 into +4VDC for use with the other VDU electronics. Also, a provisional circuit 362 is available for measuring battery voltage or otherwise providing circuitry for supporting a warning indicator as to low battery power.

Figure 6B:
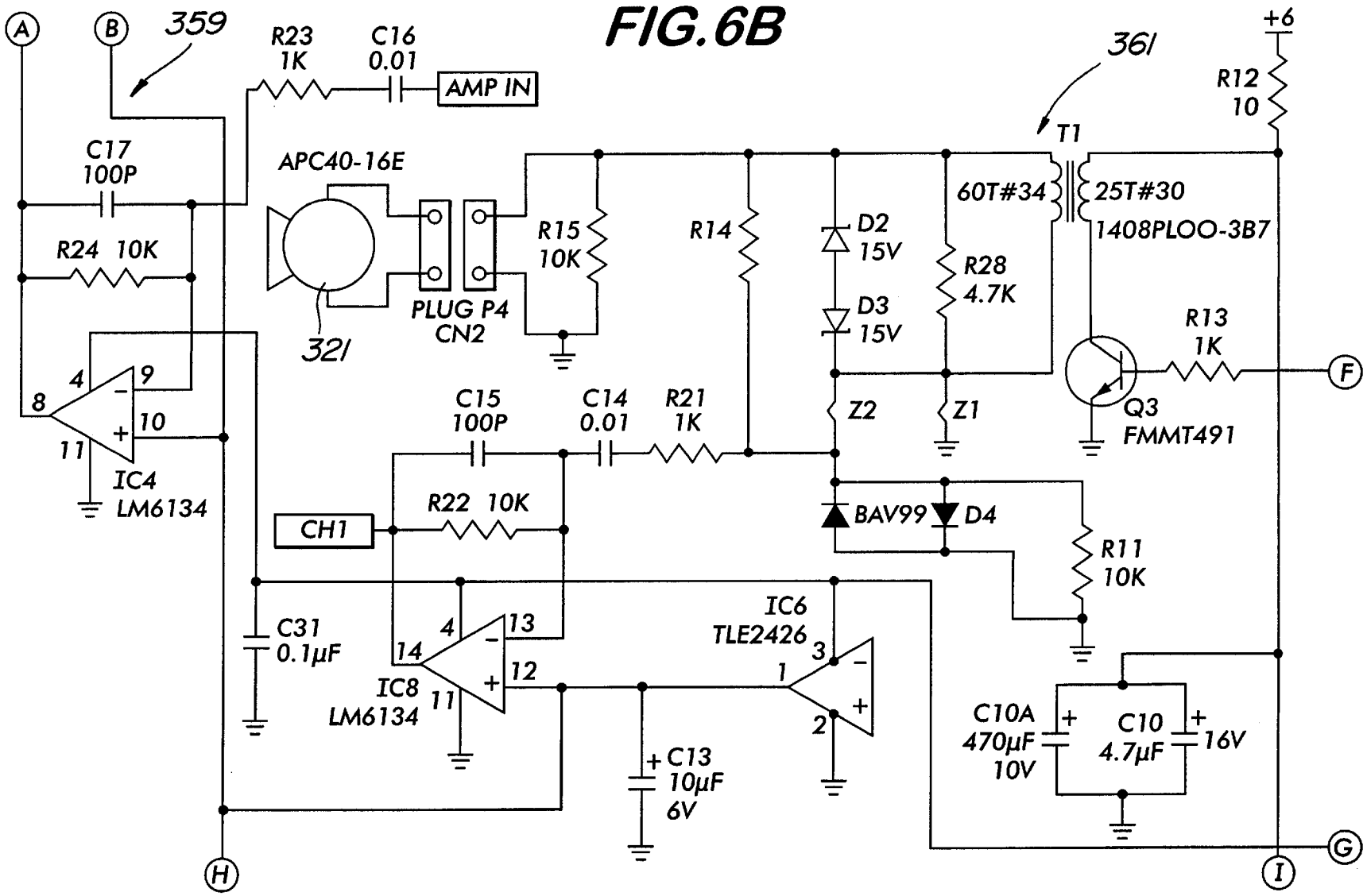
FIG. 6B is an electrical schematic of the other portion of the amplifier input circuit and the channel 1 transducer driver/listen circuit.
Figure 6C:
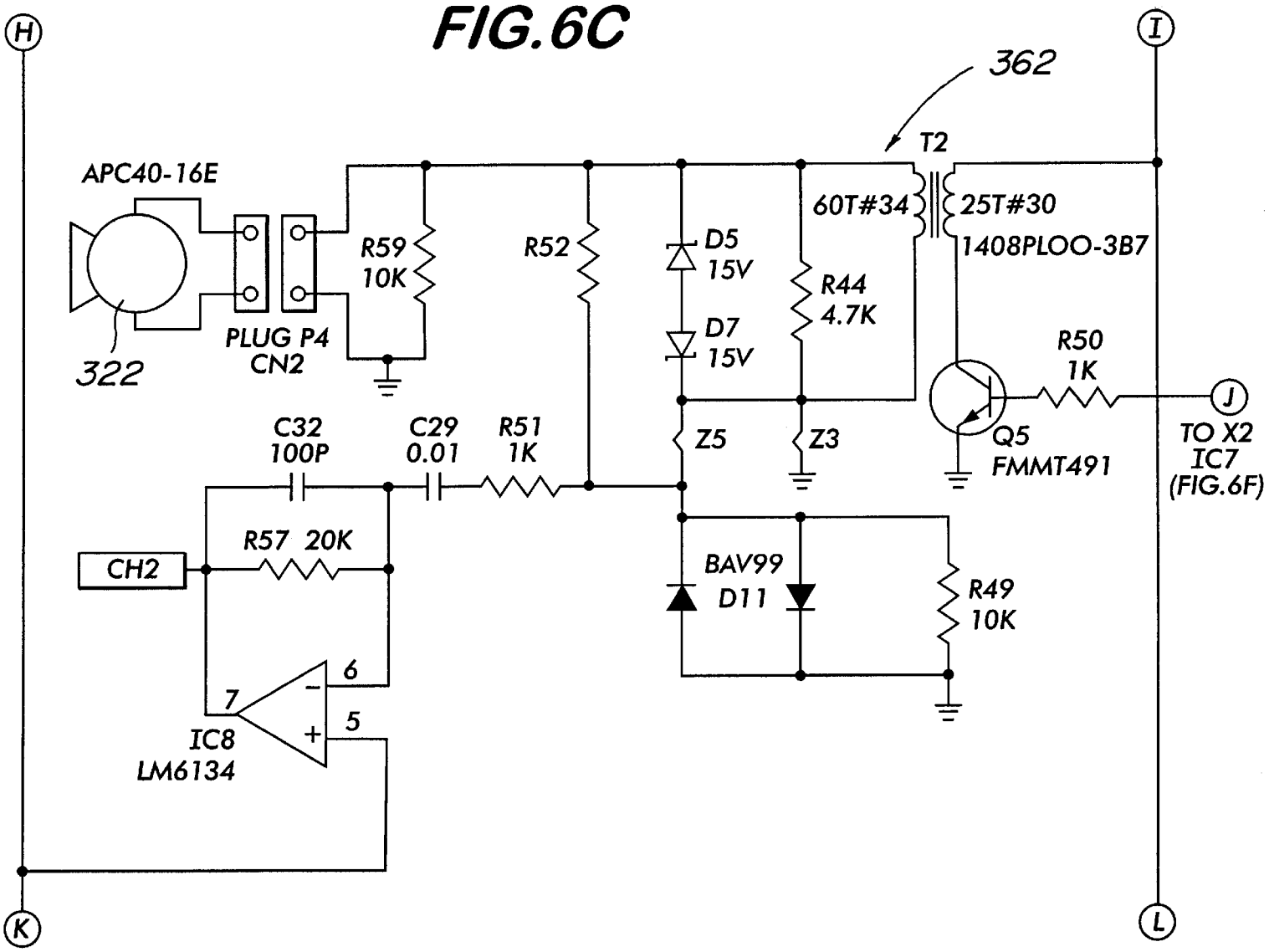
FIG. 6C is an electrical schematic of the channel 2 transducer driver/listen circuit.
Figure 6D:
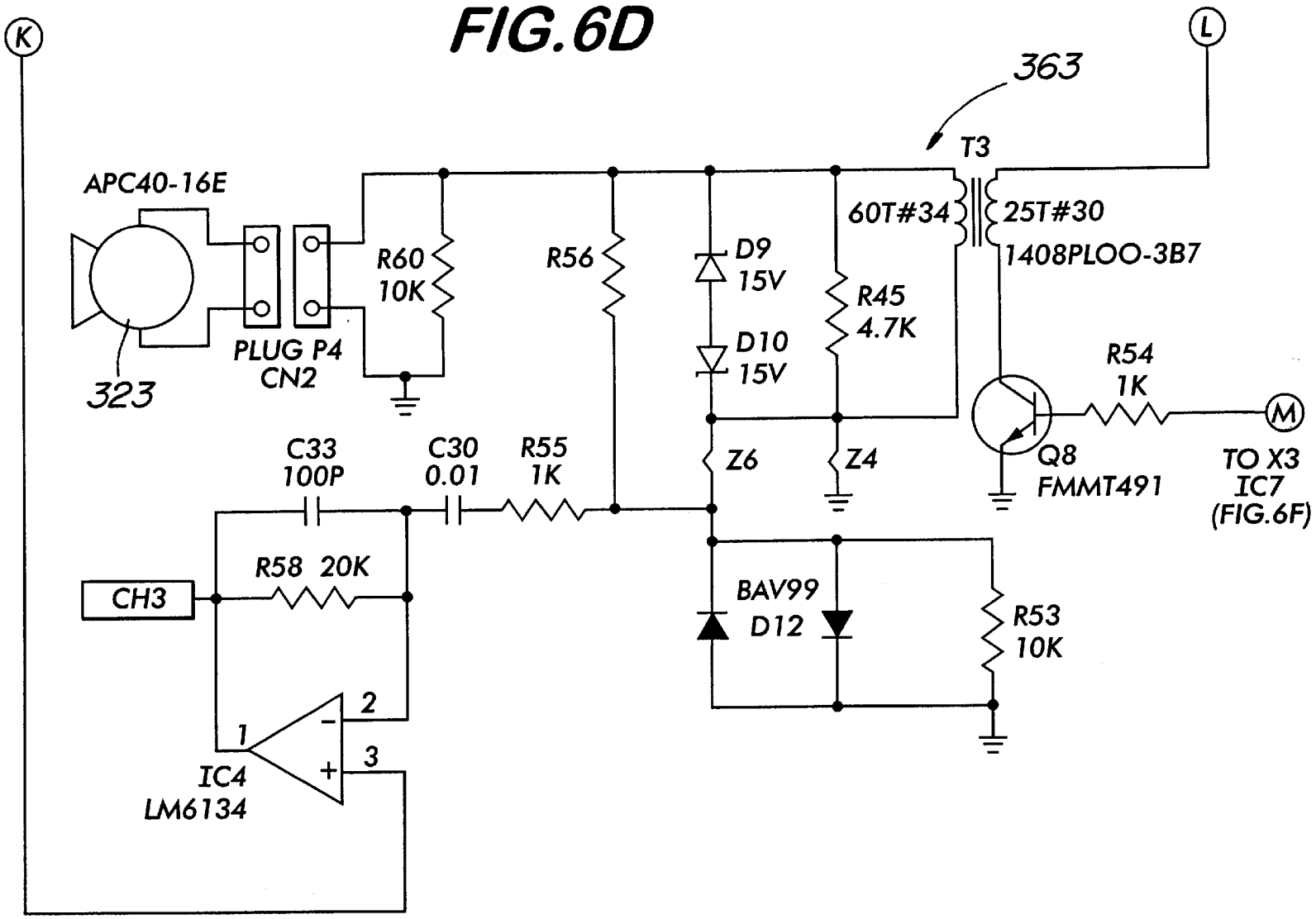
FIG. 6D is an electrical schematic of the channel 3 transducer driver/listen circuit.
Figure 6F:
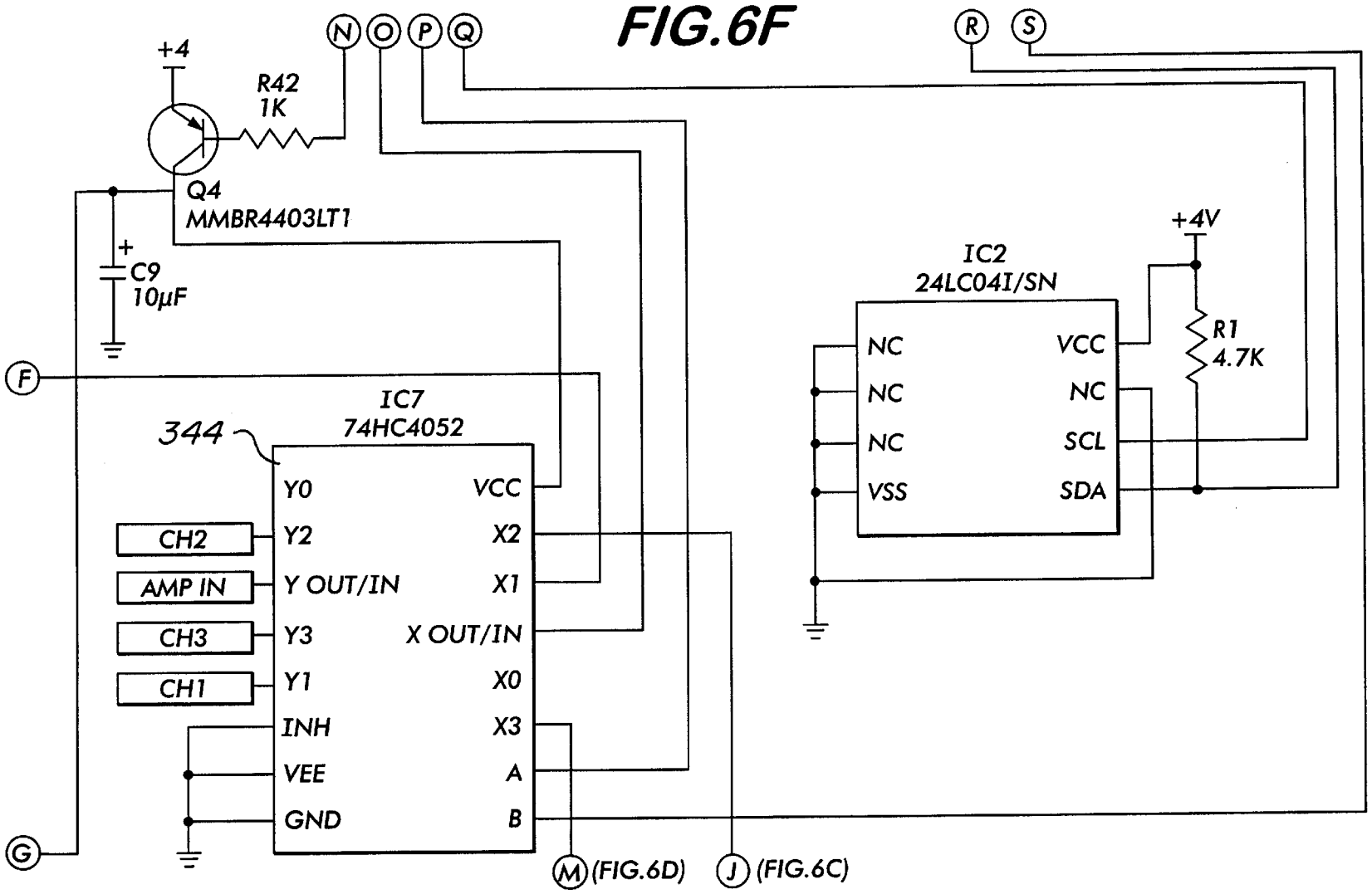
FIG. 6F is an electrical schematic of the multiplexer circuit for interfacing the three transducers to the microcontroller and of the vehicle detector unit memory.

Each transducer 321–323 has its own transducer driver/listen circuit that is selectively activated by the $\mu$C 340 through the multiplexer 344 (FIG. 6F). However, there is only one reflected-signal amplification (RSA) circuit 359 (FIGS. 6A–6B) that is selectively connected, through the multiplexer 344, to the transducer that has been activated.

The RSA circuit 359, which ultimately transmits the reflected signal to the $\mu$C 340 (pin RA0/AN0) for processing, amplifies the reflected signal in preparation for the processing. In particular, the driver/listen circuit 361 for channel 1 (transducer 321) is shown in FIG. 6B the driver/listen circuit 362 for channel 2 (transducer 322) is shown in FIG. 6C; and the driver listen circuit 363 for channel 3 (transducer 323) is shown in FIG. 6D.

The driver path in each channel comprises the transformer T1 (T2 for channel 2, and T3 for channel 3) which is energized whenever the transistor Q3 (Q5 for channel 2 and Q8 for channel 3) is biased on by the $\mu$C 340. This energizes the respective transducer for emitting the 1 msec ultrasonic signal pulse. Once emitted, the transducer then "listens" for the reflection. The listen path in each channel comprises the LM6134 amplifier coupled to the driver circuit. In particular, with regard to channel 1, the listen path is through R14, R21 and C14 into the LM6134; with regard to channel 2, the listen path is through R52, R51 and C29 into the LM6134; and with regard to channel 3, the listen path is through R56, R55 and C30 into the LM6134. The output of each LM6134 is selectively coupled, through the multiplexer 344, to the RSA circuit 359. In particular, whichever channel is activated, the channel output from the corresponding listen circuit (CH1, CH2 or CH3 shown in FIGS. 6B, 6C and 6D, respectively,) is routed, through the multiplexer 344, to the AMP IN input of the RSA circuit 359, as shown in FIG. 6B. Thus, the reflected signal received by the activated channel is processed by the $\mu$C 340, which includes digitizing the received reflected signal. The gain of the RSA circuit 359 can adjusted by the $\mu$C 340 as shown the GAIN input in FIG. 6A which is connected to pin RB5 of the $\mu$C 340 (FIG. 6E).

As discussed previously, the VDU 316 electronics can be reset automatically whenever the EPM 20 is reset via the RESET line. In the alternative, if parking authority personnel need to reset the VDU 316 directly, there is a manually-operated switch SW (FIG. 6E) that can momentarily depressed.

It should be understood that the embodiment disclosed herein is exemplary only is and that other components having higher resolution could be substituted herewith. However, bearing in mind that minimum power must be used since the parking meter 10 is a stand-alone unit, the above-described embodiment utilizes an 8-bit microcontroller (Microchip's PIC16C73-10I/P) for $\mu$C 340.

The sampling rate of the $\mu$C 340 is 3 samples/msec. Since sound travels at approximately 1 ft/msecand since onlythe return trip of the reflected signal is required (i.e., time of flight/2), in order to properly monitor a vehicle target region of 0–14 feet requires 6 samples/ft. Therefore, each activation of any transducer 321–323 results in 84 samples being temporarily stored in the $\mu$C 340 for processing. When the parking meter 10 is first installed, the baseline signal (i.e., the reflected signal corresponding to an empty parking space) for each of the transducers 321–323 is obtained and, as a result, three groups of 84 samples are stored in the memory 342.

Within the vehicle target region of 0–14 feet, the range of 2–10 feet is considered the vehicle region. When the processor analyzes the received samples, it looks for those samples having the highest values that exceed the predetermined thresholds (which are modifiable by parking meter personnel through a hand-held programming unit, not shown, and the EPM 20). These thresholds comprise values (e.g., 20 counts) above the baseline signals.

The Tamper System

Figure 6G:
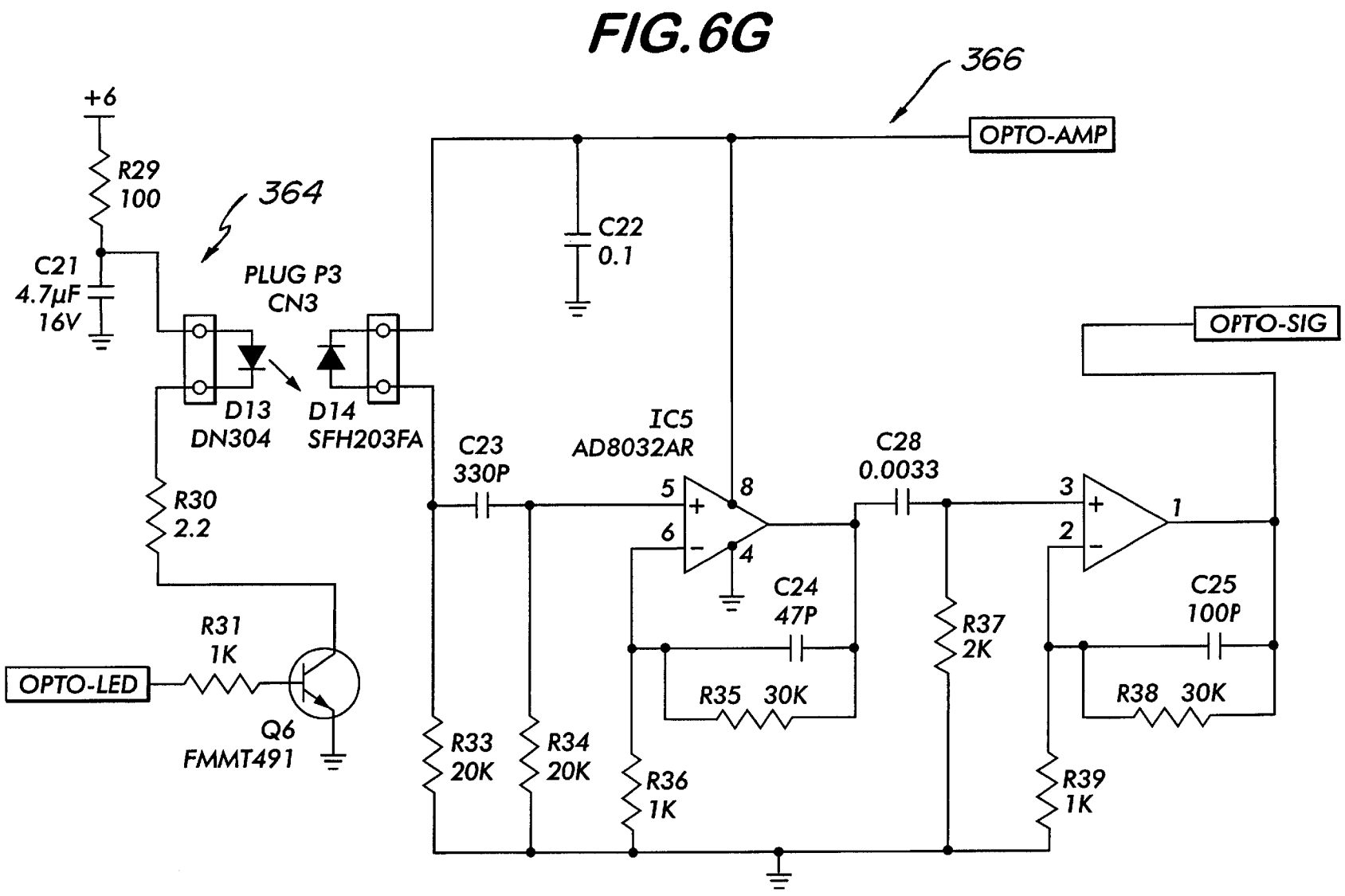
FIG. 6G is an electrical schematic of the optical tamper system.

One of the important features of the present invention is the tamper system incorporated into the VDU 316. The tamper system basically comprises three parts: (1) the optical tamper system (OTS) 346 (FIG. 6G); (2) the $\mu$C 340 monitoring of each channel for a significant decrease in the amplitude of the reflected ultrasonic signal (something touching the sensor) corresponding to a close range; and (3) the $\mu$C 340 monitoring of each channel for a significant increase in the amplitude (someone or something standing close to the transducer) of the ultrasonic signal corresponding to a close range.

Figure 8:
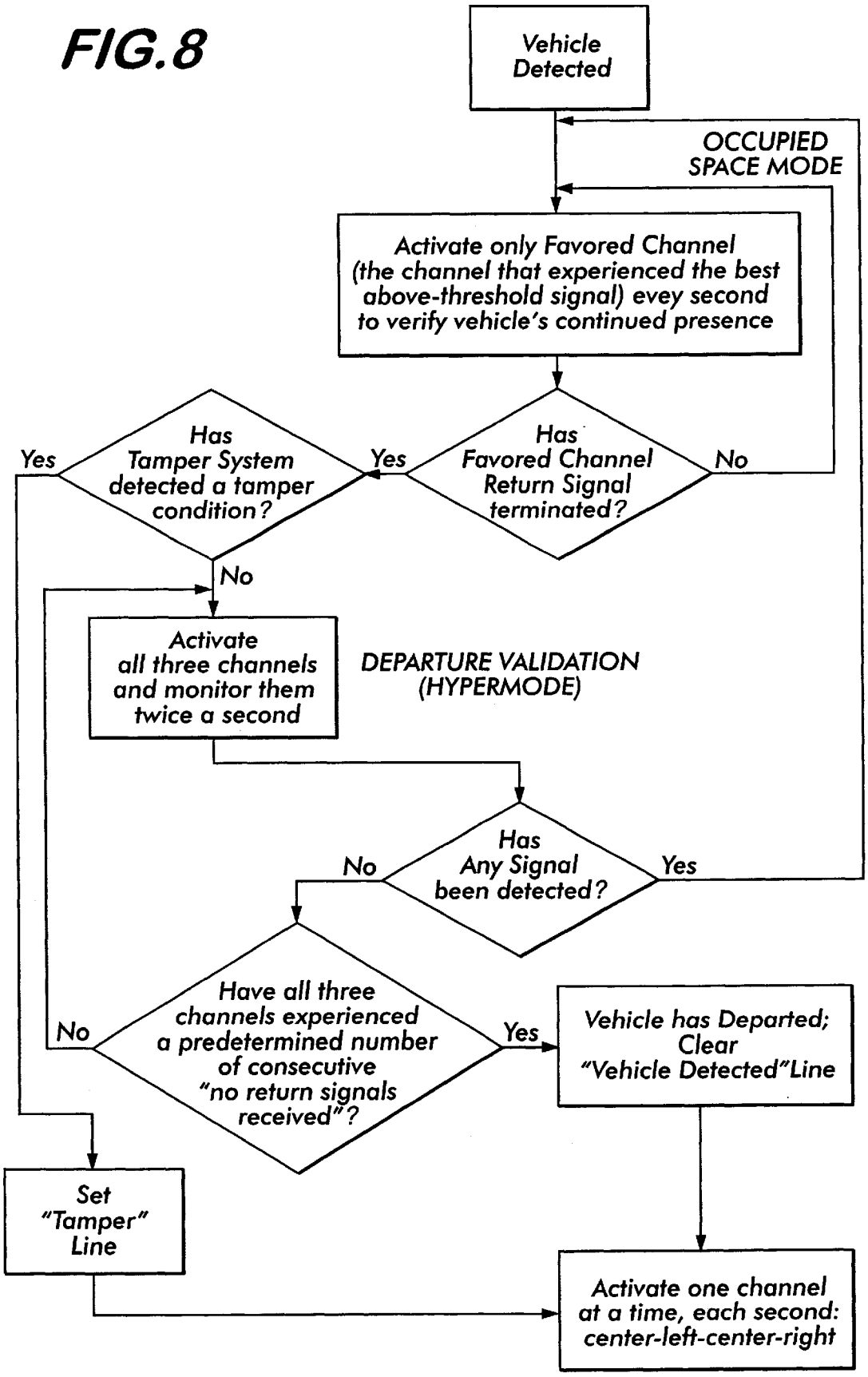
FIG. 8 is a block diagram of the software of the present invention regarding the occupied space mode and the departure validation mode.

The purpose of the OTS 346 is to provide an independent check on the ultrasonic transducers 321–323 when the ultrasonic transducers detect that a car may be departing (i.e., the favored channel return signal has terminated-see FIG. 8). If something/someone inadvertently or intentionally began diverting the ultrasonic transducer signal from the favored channel, there would be no returned reflected signal which would be interpreted by the $\mu$C 340 as an empty parking space. To verify this, the $\mu$C 340 activates the OTS 346 once per second which sends out its own optical (e.g., infrared) signal. If the parking space is truly vacated, there will be no returned optical signal and the output of the OTS detector (discussed below) sent to the $\mu$C 340 will not differ from the baseline OTS characteristic. If, on the other hand, something/someone is inadvertently or intentionally blocking the favored channel signal while a vehicle is parked in the corresponding parking space, the OTS detector will detect a returned optical signal that the $\mu$C 340 will determine is greater than the baseline OTS characteristic and, as a result, will set the "tamper line" 358. As long as the returned optical signal is greater than the baseline OTS characteristic, the $\mu$C 340 maintains the tamper line 358 set. Once the returned optical signal is restored back to the baseline OTS characteristic, the $\mu$C 340 will reset the tamper line 358.

In particular, as shown in FIG. 6G, the OTS 346 includes an infrared LED D13 and an infrared photodiode D14 which are located behind the plastic lens 324 (FIG. 1). These two components are physically positioned behind the lens to be pointed outward such that during normal operation, internal reflections of light from the LED D13 to the photodiode D14 are kept to a minimum. Furthermore, as shown in FIG. 3, the LED D13 and photodiode D14 are positioned 12°($\beta$) downward from a horizontal plane HP. The LED D13 and its connecting circuits are hereinafter referred to as the emitter 364 and the photodiode D14 and its connecting circuits are hereinafter referred to as the detector 366. The OTS 346 is activated once per second only when there is a vehicle in the corresponding parking space and when the ultrasonic transducers detect that the car may be departing (i.e., the favored channel return signal has terminated-see FIG. 8). It should be understood that the the tilt angle $\beta$ of the LED D13 and photodiode D14 can be in the same tilt angle range discussed earlier with respect to the transducers 321–323, namely $-30° < \beta < 30°$ with the preferred $\beta$ being 12°.

Assuming that the favored channel signal has been lost, operation of the OTS 346 is as follows: First, the $\mu$C 340 turns on the detector 366 by using the OPTO-AMP signal to permit the detector 366 to settle down. Second, the $\mu$C 340 turns on the OPTO-LED signal for 10 $\mu$sec to pulse the emitter 364. The AC coupling (C23 and R34) in the detector 366, forms a synchronous detection, which acts to filter out the ambient light (i.e., sunlight, car headlights, etc.) so that, if a reflected optical signal were to be detected by the detector 366, it would have to be the reflection of the 10 $\mu$sec pulse only.

If something or someone were to completely cover the plastic lens 324 during this potential vehicle departing stage, the internal reflections of the LED D13 will be maximized since the photodiode D14 would then be detecting all of the light emanating from LED D13. As a result, the detector 366 output will be greater than the baseline OTS characteristic and the $\mu$C 340 will again set the tamper line 358 for as long as that condition occurs.

In addition to the OTS 346, the tamper system of the VDU 316 also includes monitoring the reflected ultrasonic sensor signals corresponding to a close range (e.g., <2 ft). During the processing of each of these close range ultrasonic signals, the $\mu$C 340 monitors whether there has been either a significant increase/decrease in the return signal amplitude. A significant increase in the return signal amplitude over the baseline indicates that something or someone has entered into the lower end of the vehicle target region (0–2 ft), within a minimum threshold distance (e.g., $\leqq$1 foot) of the parking meter that indicates that the thing or person cannot be a vehicle since it is too close. A significant decrease in the return signal amplitude indicates that something is contacting or has been placed over the transducer (e.g., a piece of tape, chewing gum, etc.) since such contact actually inhibits the vibration of the ultrasonic sensor. Either of these events, in addition to the OTS 346 detecting a tamper condition (described above), signals to the $\mu$C 340 that the ultrasonic transducers 321–323 are being tampered with and therefore, the $\mu$C 340 will set the tamper line 358.

It should be understood that what is meant by the term "significant" can vary depending upon the type of processing means being used. For example, in the present invention using an 8-bit $\mu$C 340, a typical baseline corresponding to an empty space may be 70 counts/255 and therefore a difference of ±10–20 counts from that baseline would be considered a "significant" increase/decrease in the return signal. Where higher resolution devices are used (e.g., 10-bit or 16-bit processing means), the above values would differ. Thus, the above values given for significant increases/decreases over the baseline are by way of example only and are not meant to limit the scope of the tamper system of the present invention in any way.

The EPM 20 can use this tamper line 358 set to enter a passive mode whereby the EPM 20 is no longer relying on the vehicle detection data from the VDU 316; instead, the EPM 20 acts like a conventional parking meter by continuing to count down the time remaining on the meter. This prevents someone from trying to zero the time off of the EPM 20 while a vehicle is parked by tampering with the ultrasonic sensors 321–323. Once the tampering is terminated, the VDU 316 again begins its vehicle detection routine and normal operation is restored.

As stated earlier, the RESET line is provided so that the parking authority personnel can reset the VDU 316 at the same time that they set the EPM 20. In particular, the EPM 20 may comprise an internal reset switch. Whenever, the parking authority personnel reset the EPM 20 (e.g., when replacing the batteries in the EPM 20), the internal reset switch in the EPM 20 is activated and both the EPM 20 and VDU 316 are reset. Other than that, the RESET line is not used during normal operation.

It has been established through testing that the center transducer 321 is the most likely transducer to detect a vehicle parked in the corresponding parking space. Furthermore, the use of three channel monitoring methodology described in detail above permits the proper operation of vehicle detection while remaining unaffected by any parking meter installation variations. For example, should the installation personnel not exactly orient the street side of the VDU 316 at the corresponding parking space, the three channel monitoring will still reliably detect the vehicle in the parking space. The detection methodology used in the VDU 316 described above is designed for detecting the "quick-parker" so that even when a vehicle is able to park in the parking space just evacuated by another vehicle, the VDU 316 is able to accurately detect the first vehicle departure, inform the EPM 20, and then immediately detect the entrance of a new vehicle into the parking space. In addition, the detection methodology used in the VDU 316 is also designed for detecting vehicles parked too far forward in the parking space or too far back in the parking space.

Figure 1A:
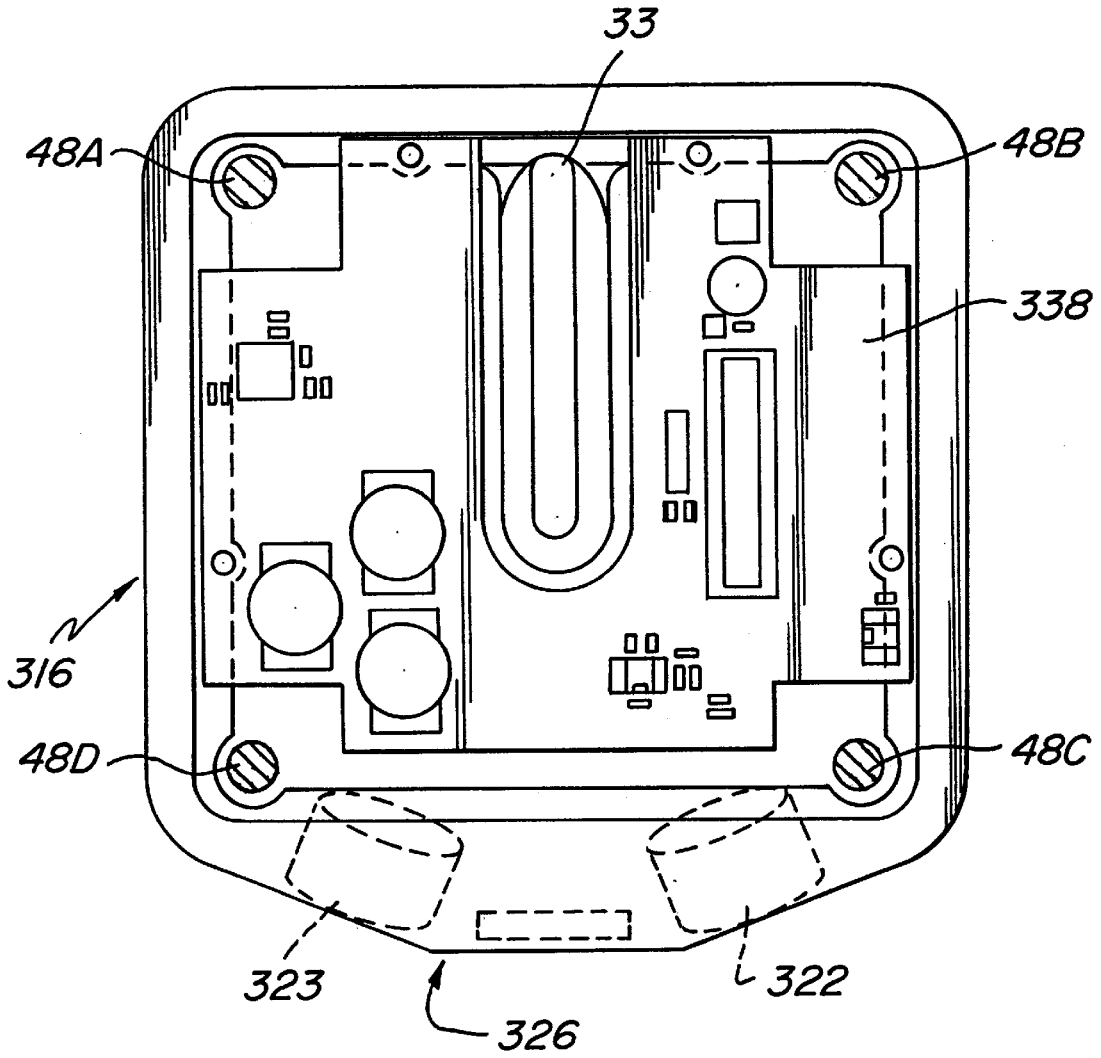
FIG. 1A is cross-sectional view of the present invention taken along lines 1A—1A of FIG. 2.
Figure 2:
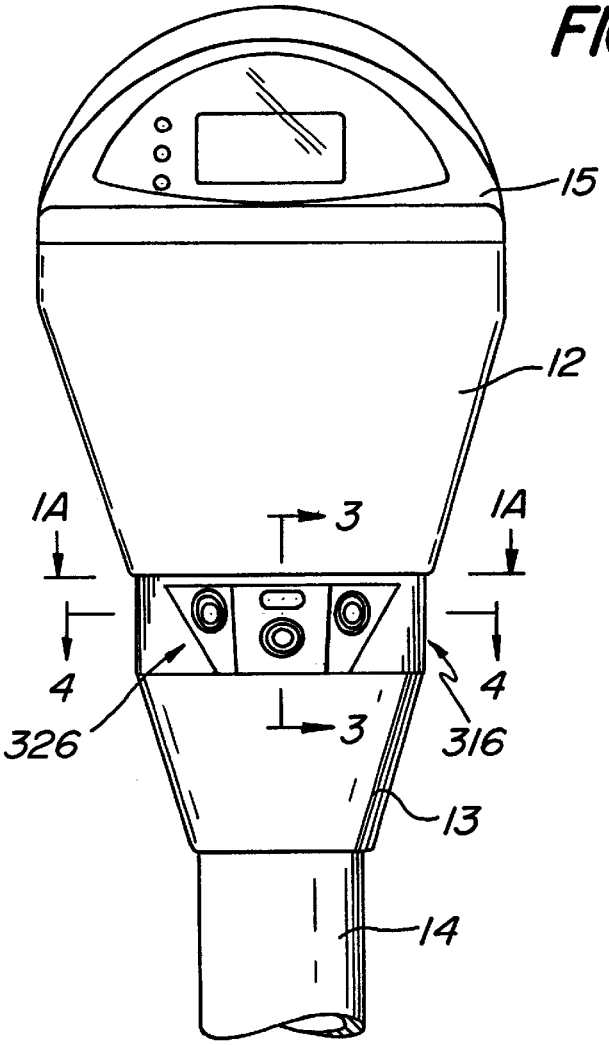
FIG. 2 is an elevated vehicle-side view of the present invention.

Another embodiment of the VDU 316 uses only two ultrasonic transducers. FIG. 1A, depicts a two transducer configuration whereby the central transducer 321 has been eliminated. In all other respects, the hardware and software operation of this second embodiment of the VDU remains the same. For example, the $\alpha$ and $\beta$ orientations of the ultrasonic sensors 322 and 323 remain the same; the four detection modes are still used except that the"outer-center-outer-center" activation scheme in the empty space mode is simply between channel 2 and channel 3. The disadvantage of the 2-transducer electronic parking meter is that the parking meter/VDU installation must be very precise or else the detection method will not work. Assuming it is installed properly, the software works the same way as with the three transducers.

Without further elaboration, the foregoing will so fully illustrate our invention that others may, by applying current or future knowledge, readily the same for use under various conditions of service.

TABLE 1

| ITEM | DESCRIPTION | MANUFACTURER | PART NO. |
|---|---|---|---|
| C1 | Ceramic Chip Capacitors 0805 5% | Murata GRM40 | 0.1UF50V |
| C2 | Tantalum Capacitor | Kemet | 4.7UF 16V |
| C3 | Ceramic Chip Capacitors 0805 5% | Murata GRM40 | 0.1UF 50V |
| C4 | Tantalum Capacitor | Kemet | 10UF 6V |
| C5 | Ceramic Chip Capacitors 0805 5% | Murata GRM40 | 0.1UF 50V |
| C6 | Ceramic Chip Capacitors 0805 5% | Murata GRM40 | 33P 50V |
| C7 | Ceramic Chip Capacitors 0805 5% | Murata GRM40 | 33P 50V |
| C9 | Tantalum Capacitor | Kemet | 10UF 6V |
| C10 | Tantalum Capacitor | Kemet | 4.7UF 16V |
| C10A | Electrolytic Cap 470UF 10 V | Panasonic | ECE-A1AU471 |
| C11 | Ceramic Chip Capacitors 0805 5% | Murata GRM40 | 0.1UF 50V |
| C12 | Ceramic Chip Capacitors 0805 5% | Murata GRM40 | 100P 50V |
| C13 | Tantalum Capacitor | Kemet | 10UF 6V |
| C14 | Ceramic Chip Capacitors 0805 5% | Murata GRM40 | 0.01 UF 50V |
| C15 | Ceramic Chip Capacitors 0805 5% | Murata GRM40 | 100P 50V |
| C16 | Ceramic Chip Capacitors 0805 5% | Murata GRM40 | 0.01 UF 50 V |
| C17 | Ceramic Chip Capacitors 0805 5% | Murata GRM40 | 100P 50 V |
| C18 | Ceramic Chip Capacitors 0805 5% | Murata GRM40 | 0.01UF 50V |
| C19 | Ceramic Chip Capacitors 0805 5% | Murata GRM40 | 100P 50V |
| C20 | Ceramic Chip Capacitors 0805 5% | Murata GRM40 | 0.01UF 50V |

TABLE 1-continued

| ITEM | DESCRIPTION | MANUFACTURER | PART NO. |
|---|---|---|---|
| C21 | Tantalum Capacitor | Kemet | 4.7UF 16V |
| C22 | Ceramic Chip Capacitors 0805 5% | Murata GRM40 | 0.1UF 50V |
| C23 | Ceramic Chip Capacitors 0805 5% | Murata GRM40 | 330P 50V |
| C24 | Ceramic Chip Capacitors 0805 5% | Murata GRM40 | 47P 50V |
| C26 | Ceramic Chip Capacitors 0805 5% | Murata GRM40 | 0.1UF 50V |
| C27 | Electrolytic Cap 470UF 10V | Panasonic | ECE-A1AU471 |
| C28 | Ceramic Chip Capacitors 0805 5% | Murata GRM40 | 100P 50V |
| C29 | Ceramic Chip Capacitors 0805 5% | Murata GRM40 | 0.01UF 50V |
| C30 | Ceramic Chip Capacitors 0805 5% | Murata GRM40 | 0.01UF 50V |
| C31 | Ceramic Chip Capacitors 0805 5% | Murata GRM40 | 0.1UF 50V |
| C32 | Ceramic Chip Capacitors 0805 5% | Murata GRM40 | 100P 50V |
| C33 | Ceramic Chip Capacitors 0805 5% | Murata GRM40 | 100P 50V |
| CN1 | Power Connector for Spacer | Molex | 22-11-2052 |
| CN2 | Connector for Ultrasonic Transducers | Molex | 22-11-2062 |
| CN3 | Connector for IR Tamper Detect | Molex | 22-11-2042 |
| D2 | Zener Diode SOT23 | Fairchild Or EQ | MMBZ5245B |
| D3 | Zener Diode SOT23 | Fairchild Or EQ | MMBZ5245B |
| D4 | Dual Diode-Small Signal | Fairchild Or EQ | BAV99 |
| D5 | Zener Diode SOT23 | Fairchild Or EQ | MMBZ5245B |
| D7 | Zener Diode SOT23 | Fairchild Or EQ | MMBZ5245B |
| D8 | Diode-Small Signal | Fairchild Or EQ | MMBD914LT1 |
| D9 | Zener Diode SOT23 | Fairchild Or EQ | MMBZ5245B |
| D10 | Zener Diode SOT23 | Fairchild Or EQ | MMBZ5245B |
| D11 | Dual Diode-Small Signal | Fairchild Or EQ | BAV99 |
| D12 | Dual Diode-Small Signal | Fairchild Or EQ | BAV99 |
| D13 | LED | II Stanley | DN304 |
| D14 | Photodiode | Siemens | SFH203FA |
| IC1 | Microcomputer | Microchip | PIC16C73-10I/P |
| IC2 | EEPROM | Microchip | 24LC04-I/SN |
| IC4 | Quad Op Amp | National Or EQ | LM6134BIM |
| IC5 | Dual Op Amp | Analog Devices | AD8032AR |
| IC6 | Voltage Divider | TI | TLE2426ID |
| IC7 | Dual 4 Line Mux | Fairchild Or EQ | MM74HC4052M |
| IC8 | Quad Op Amp | National Or EQ | LM6134BIM |
| PCB1 | Printed Circuit Board-2 sided 6 × 4 in. | | |
| P1 | Plug for Veh Det Side of Cable | Molex | 22-01-3057 |
| | Pins for Above (5) | Molex | 08-55-0102 |
| P2 | Plug for Meter Side of Cable | Amp | 87631-2 |
| | Pins for Above (5) | Amp | 102128-1 |
| P3 | Plug for Ultrasonic Transducers | Molex | 22-01-3067 |
| | Pins for Above (6) | Molex | 08-55-0102 |
| P4 | Plug for IR Tamper Detect | Molex | 22-01-3047 |
| | Pins for Above (4) | Molex | 08-55-0102 |
| Cable | 5 Conductor Jacketed Cable - 20 inches | Alpha Wire Corp | 1175C |
| Q3 | Transistor-NPN | Zetex | FMMT491 |
| Q4 | Small Signal Transistor-PNP | Fairchild Or EQ | MMBR4403LT1 |
| Q6 | Transistor - NPN | Zetex | FMMT489 |
| Q5 | Transistor - NPN | Zetex | FMMT491 |
| Q7 | Small Signal Transistors-NPN | Fairchild Or EQ | MMBR4401LT1 |
| Q8 | Transistor-NPN | Zetex | FMMT491 |
| R1 | Resistor 0805 SMD 5% | Dale CRCW-0805 | 4.7K |

TABLE 1-continued

| ITEM | DESCRIPTION | MANUFACTURER | PART NO. |
|---|---|---|---|
| R2 | Resistor 0805 SMD 5% | Dale CRCW-0805 | 4.7K |
| R12 | Resistor 0805 SMD 5% | Dale CRCW-0805 | 10 |
| R13 | Resistor 0805 SMD 5% | Dale CRCW-0805 | 1K |
| R14 | Resistor 0805 SMD 5% | Dale CRCW-0805 | 2K |
| R15 | Resistor 0805 SMD 5% | Dale CRCW-0805 | 10K |
| R16 | Resistor 0805 SMD 5% | Dale CRCW-0805 | 1K |
| R18 | Resistor 0805 SMD 5% | Dale CRCW-0805 | 47K |
| R20 | Resistor 0805 SMD 5% | Dale CRCW-0805 | 10K |
| R21 | Resistor 0805 SMD 5% | Dale CRCW-0805 | 1K |
| R22 | Resistor 0805 SMD 5% | Dale CRCW-0805 | 20K |
| R23 | Resistor 0805 SMD 5% | Dale CRCW-0805 | 1K |
| R24 | Resistor 0805 SMD 5% | Dale CRCW-0805 | 10K |
| R25 | Resistor 0805 SMD 5% | Dale CRCW-0805 | 1K |
| R26 | Resistor 0805 SMD 5% | Dale CRCW-0805 | 20K |
| R27 | Resistor 0805 SMD 5% | Dale CRCW-0805 | 10K |
| R27 | Resistor 0805 SMD 5% | Dale CRCW-0805 | 10K |
| R29 | Resistor 0805 SMD 5% | Dale CRCW-0805 | 100 |
| R30 | Resistor 0805 SMD 5% | Dale CRCW-0805 | 2.2 |
| R31 | Resistor 0805 SMD 5% | Dale CRCW-0805 | 1K |
| R32 | Resistor 0805 SMD 5% | Dale CRCW-0805 | 100K |
| R33 | Resistor 0805 SMD 5% | Dale CRCW-0805 | 20K |
| R34 | Resistor 0805 SMD 5% | Dale CRCW-0805 | 20K |
| R35 | Resistor 0805 SMD 5% | Dale CRCW-0805 | 33K |
| R36 | Resistor 0805 SMD 5% | Dale CRCW-0805 | 1K |
| R37 | Resistor 0805 SMD 5% | Dale CRCW-0805 | 1K |
| R38 | Resistor 0805 SMD 5% | Dale CRCW-0805 | 1K |
| R38 | Resistor 0805 SMD 5% | Dale CRCW-0805 | 33K |
| R40 | Resistor 0805 SMD 5% | Dale CRCW-0805 | 10K |
| R42 | Resistor 0805 SMD 5% | Dale CRCW-0805 | 1K |
| R43 | Resistor 0805 SMD 5% | Dale CRCW-0805 | 8.2K |
| R46 | Resistor 0805 SMD 5% | Dale CRCW-0805 | 2K |
| R47 | Resistor 0805 SMD 5% | Dale CRCW-0805 | 3.9K |
| R48 | Resistor 0805 SMD 5% | Dale CRCW-0805 | 8.2K |
| R50 | Resistor 0805 SMD 5% | Dale CRCW-0805 | 1K |
| R51 | Resistor 0805 SMD 5% | Dale CRCW-0805 | 1K |
| R52 | Resistor 0805 SMD 5% | Dale CRCW-0805 | 2K |
| R54 | Resistor 0805 SMD 5% | Dale CRCW-0805 | 1K |
| R55 | Resistor 0805 SMD 5% | Dale CRCW-0805 | 1K |

TABLE 1-continued

| ITEM | DESCRIPTION | MANUFACTURER | PART NO. |
|---|---|---|---|
| R56 | Resistor 0805 SMD 5% | Dale CRCW-0805 | 2K |
| R57 | Resistor 0805 SMD 5% | Dale CRCW-0805 | 20K |
| R58 | Resistor 0805 SMD 5% | Dale CRCW-0805 | 20K |
| R59 | Resistor 0805 SMD 5% | Dale CRCW-0805 | 10K |
| R60 | Resistor 0805 SMD 5% | Dale CRCW-0805 | 10K |
| S1 | Reset Switch | Panasonic | EVQ-PBC09K |
| T1 | Transformer | Datatronics | REF 21817 |
| T2 | Transformer | Datatronics | REF 21817 |
| T3 | Transformer | Datatronics | REF 21817 |
| U1 | Ultrasonic Transducer | APC | APC40T/R-16E |
| U2 | Ultrasonic Transducer | APC | APC40T/R-16E |
| U3 | Ultrasonic Transducer | APC | APC40T/R-16E |
| VR1 | Voltage Regulator | Seiko Telcom | S81240PG TC55RP4002 ECB713 |
| X1 | 9.8304 MHZ Crystal | Mtron | |
| Z1 | Zero Ohm Jumper 0895 | Dale CRCW-0805 | |
| Z3 | Zero Ohm Jumper 0805 | Dale CRCW-0805 | |
| Z4 | Zero Ohm Jumper 0805 | Dale CRCW-0805 | |

We claim:

1. A vehicle detector unit for use with an electronic parking meter for detecting the presence or absence of a vehicle in a corresponding parking space, said unit comprising:

a first signal emitting sensor positioned adjacent the corresponding parking space for transmitting a first signal towards the parking space in a first direction and for receiving a reflection of said first signal;

a second signal emitting sensor positioned adjacent the corresponding parking space for transmitting a second signal towards the parking space in a second direction different from said first direction and for receiving a reflection of said second signal;

processing means coupled to said first and second signal-emitting sensors for processing said reflections of said first and second signals to determine if a vehicle is positioned in the corresponding parking space, said processor means coupled to the electronic parking meter for communicating the presence or absence of a vehicle in the corresponding parking space to the electronic parking meter;

means for storing a first reflected signal corresponding to an empty parking space for said first signal-emitting sensor and a second reflected signal corresponding to the empty parking space for said second signal-emitting sensor, said storing means being coupled to said processing means; and a tamper detection system, said tamper detection system being coupled to said processing means for detecting inadvertent or intentional tampering of said first or second signal-emitting sensors.

2. The vehicle detector unit of claim 1 wherein tamper detection system comprises an optical signal emitter and detector coupled to said processor means, said optical signal emitter and detector being positioned toward the corresponding parking space.

3. The vehicle detector unit of claim 2 wherein said means for storing includes a reflected signal corresponding to an unobstructed path towards the corresponding parking space for said optical signal emitter.

4. The vehicle detector unit of claim 2 wherein the optical signal emitter and detector comprise an infrared light emitting diode and an infrared photodetector.

5. The vehicle detector unit of claim 1 further comprising a housing having a side which is positioned towards the corresponding parking space, said side including said first and second signal-emitting sensors at a first angular orientation and a second angular orientation, respectively, said first angular orientation being in the range of 0–45 degrees away from a vertical plane through said side and said second angular orientation being in the range of 0–45 degrees in the opposite direction of said first angular orientation from said vertical plane.

6. The vehicle detector unit of claim 5 wherein said first and second signal-emitting sensors are positioned at an angular orientation in the range of −30 to 30 degrees from a horizontal plane.

7. The vehicle detector unit of claim 1 further comprising a housing having a side which is positioned towards the corresponding parking space, said side including said first and second signal-emitting sensors at a first angular orientation and a second angular orientation, respectively, said first angular orientation being 22½ degrees away from a vertical plane through said side and said second angular orientation being 22½ degrees in the opposite direction of said first angular orientation from said vertical plane.

8. The vehicle detector unit of claim 7 wherein said first and second signal-emitting sensors are positioned downward from a horizontal plane at an angular orientation of 12 degrees.

9. The vehicle detector unit of claim 8 further comprising means for storing a first reflected signal corresponding to an empty parking space for said first signal-emitting sensor and a second reflected signal corresponding to the empty parking space for said second signal-emitting sensor, said storing means being coupled to said processing means.

10. The vehicle detector unit of claim 9 further comprising a tamper detection system, said tamper detection system coupled to said processing means for detecting inadvertent or intentional tampering of said first or second signal-emitting sensors.

11. The vehicle detector unit of claim 10 wherein tamper detection system comprises an optical signal emitter and detector coupled to said processor means, said optical signal emitter and detector being positioned toward the corresponding parking space.

12. The vehicle detector unit of claim 11 wherein said optical signal emitter and emitter are positioned between said first and second signal-emitting means and wherein said emitter and detector are positioned at an angular orientation in the range of −30 to 30 degrees from said horizontal plane.

13. The vehicle detector unit of claim 11 wherein said optical signal emitter and emitter are positioned between said first and second signal-emitting means and wherein said emitter and detector are positioned downward from said horizontal plane at said angular orientation of 12 degrees.

14. The vehicle detector unit of claim 11 wherein said means for storing includes a reflected signal corresponding to an unobstructed path towards the corresponding parking space for said optical signal emitter.

15. A vehicle detector unit for use with an electronic parking meter for detecting the presence or absence of a vehicle in a corresponding parking space, said unit comprising:

a first signal emitting sensor positioned adjacent the corresponding parking space for transmitting a first signal towards the parking space in a first direction and for receiving a reflection of said first signal;

a second signal emitting sensor positioned adjacent the corresponding parking space for transmitting a second signal towards the parking space in a second direction different from said first direction and for receiving a reflection of said second signal; and processing means coupled to said first and second signal-emitting sensors for processing said reflections of said first and second signals to determine if a vehicle is positioned in the corresponding parking space, said processor means coupled to the electronic parking meter for communicating the presence or absence of a vehicle in the corresponding parking space to the electronic parking meter;

a third signal-emitting sensor, positioned in between said first and second signal-emitting sensors, for transmitting a third signal towards the parking space in a third direction, different from said first and second directions and for receiving a reflection of said third signal, said third signal-emitting means being coupled to said processing means;

wherein said processing means processes said reflection of said third signal, in addition to processing said reflections of said first and second signals, to determine if a vehicle is positioned in the corresponding parking space;

said first direction being towards a front portion of the corresponding parking space, said second direction being towards a back portion of the corresponding parking space and said third direction being towards a center portion of the corresponding parking space;

means for storing a first reflected signal corresponding to an empty parking space for said first signal-emitting sensor, a second reflected signal corresponding to the empty parking space for said second signal-emitting sensor and a third reflected signal corresponding to the empty parking space for said third signal-emitting sensor, said storing means being coupled to said processing means; and a tamper detection system, said tamper detection system being coupled to said processing means for detecting inadvertent or intentional tampering of said first, second and third signal-emitting sensors.

16. The vehicle detector unit of claim 15 wherein tamper detection system comprises an optical signal emitter and detector coupled to said processor means, said optical signal emitter and detector being positioned toward the corresponding parking space and positioned above said third signal-emitting sensor.

17. The vehicle detector unit of claim 16 wherein said means for storing includes a reflected signal corresponding to an unobstructed path towards the corresponding parking space for said optical signal emitter.

18. The vehicle detector unit of claim 15 further comprising a housing having a side which is positioned towards the corresponding parking space, said side including said first and second signal-emitting sensors at a first angular orientation and a second angular orientation, respectively, said first angular orientation being in the range of 0–45 degrees away from a vertical plane through said side and said second angular orientation being in the range of 0–45 degrees in the opposite direction of said first angular orientation from said vertical plane.

19. The vehicle detector unit of claim 15 further comprising a housing having a side which is positioned towards the corresponding parking space, said side including said first and second signal-emitting sensors at a first angular orientation and a second angular orientation, respectively, said first angular orientation being 22½ degrees away from a vertical plane through said side and said second angular orientation being 22½ degrees in the opposite direction of said first angular orientation from said vertical plane.

20. The vehicle detector unit of claim 19 wherein said first, second and third signal-emitting sensors are positioned at an angular orientation in the range of −30 to 30 degrees from a horizontal plane.

21. The vehicle detector unit of claim 19 wherein said first, second and third signal-emitting sensors are positioned downward from a horizontal plane at an angular orientation of 12 degrees.

22. The vehicle detector unit of claim 19 further comprising means for storing a first reflected signal corresponding to an empty parking space for said first signal-emitting sensor, a second reflected signal corresponding to the empty parking space for said second signal-emitting sensor and a third reflected signal corresponding to the empty parking space for said third signal-emitting sensor, said storing means being coupled to said processing means.

23. The vehicle detector unit of claim 22 further comprising a tamper detection system, said tamper detection system coupled to said processing means for detecting inadvertent or intentional tampering of said first, second or third signal-emitting sensors.

24. The vehicle detector unit of claim 23 wherein tamper detection system comprises an optical signal emitter and detector coupled to said processor means, said optical signal emitter and detector being positioned toward the corresponding parking space.

25. The vehicle detector unit of claim 24 wherein said optical signal emitter and emitter are positioned above said third signal-emitting means and wherein said emitter and detector are positioned at an angular orientation in the range of −30 to 30 degrees from said horizontal plane.

26. The vehicle detector unit of claim 24 wherein said optical signal emitter and emitter are positioned above said third signal-emitting means and wherein said emitter and detector are positioned downward from said horizontal plane at said angular orientation of 12 degrees.

27. The vehicle detector unit of claim 26 wherein said means for storing includes a reflected signal corresponding to an unobstructed path towards the corresponding parking space for said optical signal emitter.

28. A method for detecting a vehicle at a parking space, said method comprising the steps of:

(a) positioning two signal-emitting sensors adjacent the parking space, said sensors being oriented toward the parking space;

(b) alternately activating said two signal-emitting sensors, at a first predetermined interval, each of said two signal-emitting sensors both emitting signals and receiving reflections of said emitted signals to form a first set of reflected signals;

(c) processing each of said reflected signals to determine if the amplitude of at least one of said first set of reflected signals is above a predetermined threshold;

(d) alternately activating said two signal-emitting sensors at a second shorter predetermined interval to both emit signals and to receive reflections of said emitted signals to form a second set of reflected signals whenever the amplitude of at least one reflected signal of said first set of reflected signals exceeds said predetermined threshold;

(e) processing each of said second set of reflected signals to determine if a predetermined number of consecutive reflected signals in said second set comprise amplitudes that exceed said predetermined threshold for establishing the presence of a vehicle in the parking space; and (f) transmitting a signal indicative of a vehicle detected.

29. The method of claim 28 wherein said step of positioning two signal-emitting sensors adjacent the parking space comprises:

(a) clearing the parking space on a one-time basis to form an empty parking space;

(b) activating each of said two signal-emitting sensors alternately at said first predetermined interval to establish a baseline signal for each of said two signal-emitting sensors on a one-time basis;

(c) storing each of said respective baseline signals in a storage means for use in said step of processing each of said second set of reflected signals.

30. The method of claim 29 further comprising the steps of:

(a) selecting one of said two signal-emitting sensors that received a signal in said second set of reflected signals having the highest amplitude; and (b) activating only said selected one of said two signal-emitting sensors at said first predetermined interval to form a third set of reflected signals.

31. The method of claim 30 further comprising the steps of:

(a) alternately activating said two sensors at a third predetermined interval whenever said third set of signals disappear to determine if a parked vehicle has departed;

(b) terminating the transmission of said signal indicative of a vehicle detected whenever said two sensors experience a predetermined number of consecutive no receipt of reflected signals from said alternate activation of said two sensors at said third predetermined interval.

32. The method of claim 31 further comprising the steps of:

(a) positioning an optical signal sensor adjacent the parking space and orienting it toward the parking space;

(b) activating said optical signal sensor on a one-time basis while the parking space is empty to obtain a baseline signal for said optical signal-emitting sensor;

(c) storing said optical sensor baseline signal in a storage means;

(d) activating said optical sensor at said first predetermined interval to generate optical signal reflections whenever said third set of signals disappear;

(e) comparing said optical signal reflections to said optical sensor baseline to determine if a tamper condition is present; and (f) transmitting a signal indicative of a tamper condition whenever the amplitude of said optical signal reflections is greater than said optical sensor baseline.

33. The method of claim 32 wherein said optical sensor comprises an infrared emitter and an infrared detector.

34. The method of claim 30 further comprising the steps of:

(a) alternately activating said two sensors at a third predetermined interval whenever said third set of signals disappear to determine if a parked vehicle has departed;

(b) monitoring the change in amplitude of any reflected signals from said alternate activation of said two sensors at said third predetermined interval that correspond to a predetermined range away from said at least two signal-emitting sensors; and (c) transmitting a signal indicative of a tamper condition whenever said change in amplitude is greater than a second predetermined threshold or less than a third predetermined threshold.

35. The method of claim 28 wherein said step of positioning two signal-emitting sensors comprises orienting said at least two signal-emitting sensors in opposite directions at an angle in the range of 0 to 45 degrees from a vertical plane.

36. The method of claim 28 wherein said step of positioning two signal-emitting sensors comprises orienting said at least two signal-emitting sensors in opposite directions at an angle of 22½ degrees from a vertical plane.

37. The method of claim 36 wherein said step of positioning a third signal-emitting sensor between said two signal-emitting sensors comprises orienting all of said signal-emitting sensors at an angular orientation in the range of −30 to 30 degrees from a horizontal plane.

38. The method of claim 36 wherein said step of positioning a third signal-emitting sensor between said two signal-emitting sensors comprises orienting all of said signal-emitting sensors downward at an angle of 12 degrees from a horizontal plane.

39. The method of claim 36 wherein said step of positioning two signal-emitting sensors comprises orienting said two signal-emitting sensors at an angular orientation in the range of −30 to 30 degrees from a horizontal plane.

40. The method of claim 36 wherein said step of positioning two signal-emitting sensors comprises orienting said two signal-emitting sensors downward at an angle of 12 degrees from a horizontal plane.

41. The method of claim 28 further comprising the step of positioning a third signal-emitting sensor between said two signal-emitting sensors.

42. The method of claim 41 further comprising the steps of:

(a) modifying said step of alternately activating said two signal-emitting sensors by alternately:

(1) activating one of said two signal-emitting sensors;

(2) activating said third signal-emitting sensor;

(3) activating the other one of said two signal-emitting sensors;

(4) activating said third signal-emitting sensor;

(5) repeating sensor sequencing steps (1)–(4) at said first predetermined interval to generate said first set of reflected signals; and (b) modifying said step of alternately activating said two signal emitting sensors at said second shorter predetermined interval by alternately and sequentially activating said three sensors at said second shorter predetermined interval to form said second set of reflected signals.

43. The method of claim 42 wherein said step of positioning a third signal-emitting sensor adjacent the parking space comprises:

(a) clearing the parking space on a one-time basis to form an empty parking space;

(b) activating each of said three signal-emitting sensors alternately at said first predetermined interval to establish a baseline signal for each of said three signal-emitting sensors on a one-time basis;

(c) storing each of said respective baseline signals in a storage means for use in said step of processing each of said second set of reflected signals.

44. The method of claim 43 further comprising the steps of:

(a) selecting one of said three signal-emitting sensors that received a signal in said second set of reflected signals having the highest amplitude; and (b) activating only said selected one of said three signal-emitting sensors at said first predetermined interval to form a third set of reflected signals.

45. The method of claim 44 further comprising the steps of:

(a) alternately activating said three sensors at a third predetermined interval whenever said third set of signals disappear to determine if a parked vehicle has departed;

(b) terminating the transmission of said signal indicative of a vehicle detected whenever said three sensors experience a predetermined number of consecutive no receipt of reflected signals from said alternate activation of said three sensors at said third predetermined interval.

46. The method of claim 45 further comprising the steps of:

(a) positioning an optical signal sensor adjacent the parking space and orienting it toward the parking space;

(b) activating said optical signal sensor on a one-time basis while the parking space is empty to obtain a baseline signal for said optical signal-emitting sensor;

(c) storing said optical sensor baseline signal in a storage means;

(d) activating said optical sensor at said first predetermined interval to generate optical signal reflections whenever said third set of signals disappear;

(e) comparing said optical signal reflections to said optical sensor baseline to determine if a tamper condition is present; and (f) transmitting a signal indicative of a tamper condition whenever the amplitude of said optical signal reflections is greater than said optical sensor baseline.

47. The method of claim 44 further comprising the steps of:

(a) alternately activating said three sensors at a third predetermined interval whenever said third set of signals disappear to determine if a parked vehicle has departed;

(b) monitoring the change in amplitude of any reflected signals from said alternate activation of said three sensors at said third predetermined interval that correspond to a predetermined range away from said three signal-emitting sensors; and (c) transmitting a signal indicative of a tamper condition whenever said change in amplitude is greater than a second predetermined threshold or less than a third predetermined threshold.

48. The method of claim 41 wherein said step of positioning a third signal-emitting sensor between said two signal-emitting sensors comprises orienting said two signal-emitting sensors in opposite directions at an angle in the range of 0 to 45 degrees from a vertical plane.

49. The method of claim 41 wherein said step of positioning a third signal-emitting sensor between said two signal-emitting sensors comprises orienting said two signal-emitting sensors in opposite directions at an angle of 22½ degrees from a vertical plane.

50. The method of claim 28 wherein said first predetermined interval comprises one second.

51. The method of claim 28 wherein said second predetermined interval comprises 50 msec.

52. The method of claim 28 wherein said predetermined threshold is the noise level of the parking space.

53. The method of claim 28 wherein the predetermined number of consecutive reflected signals is six.

* * * * *